US010920532B2

(12) United States Patent
Fong et al.

(10) Patent No.: US 10,920,532 B2
(45) Date of Patent: Feb. 16, 2021

(54) SQUEEZE PACKER AND METHOD OF SETTING A SQUEEZE PACKER

(71) Applicant: Coretrax Technology Limited, Aberdeen (GB)

(72) Inventors: Jason Fong, Aberdeen (GB); John Fraser, Aberdeen (GB)

(73) Assignee: Coretrax Technology Limited

( * ) Notice: Subject to any disclaimer, the term of this patent is extended or adjusted under 35 U.S.C. 154(b) by 299 days.

(21) Appl. No.: 16/061,200

(22) PCT Filed: Dec. 22, 2016

(86) PCT No.: PCT/GB2016/054031

§ 371 (c)(1),
(2) Date: Jun. 11, 2018

(87) PCT Pub. No.: WO2017/081494

PCT Pub. Date: May 18, 2017

(65) Prior Publication Data

US 2020/0270967 A1 Aug. 27, 2020

(30) Foreign Application Priority Data

Dec. 22, 2015 (GB) ..... 1522652.5

(51) Int. Cl.
*E21B 33/129* (2006.01)
*E21B 34/14* (2006.01)
(Continued)

(52) U.S. Cl.
CPC ..... *E21B 34/142* (2020.05); *E21B 33/1285* (2013.01); *E21B 33/1293* (2013.01); *E21B 34/102* (2013.01); *E21B 33/14* (2013.01)

(58) Field of Classification Search
CPC ..... E21B 33/1283; E21B 33/1293
(Continued)

(56) References Cited

U.S. PATENT DOCUMENTS 3,556,220 A 1/1971 Schwegman
4,151,875 A 5/1979 Sullaway
(Continued)

OTHER PUBLICATIONS

Coretrax: "Coretrax—CX-SV Squeeze Packer", retrieved from the internet: url: https://www.youtube.com/wach?v=yFK9sb41o0M, published on Jun. 22, 2016, retrieved on Feb. 6, 2017, 1 page.
(Continued)

*Primary Examiner* — Taras P Bemko
(74) *Attorney, Agent, or Firm* — Husch Blackwell LLP

(57) ABSTRACT

A squeeze packer (1) assembly incorporates a built-in setting tool which removes the need for a separate setting tool. The packer comprises a body comprising a mandrel (9), a shuttle sleeve (7), and a stinger (2) assembly which is lowered into the wellbore on the end of tubing (102). The shuttle sleeve is housed within the body and incorporates a latch device in the form of a collet comprising a plurality of resilient fingers (14) to releasably connect to the stinger. A ball seat (15) allows hydraulic setting of slips (3). Additional slips (4) can be set by applying tension on the tubing (FIG. 4). Once released, the stinger can open and close the shuttle sleeve by reciprocating in and out of the packer as many times as required during cementing operations.

24 Claims, 15 Drawing Sheets

(51) Int. Cl.
*E21B 33/128* (2006.01)
*E21B 34/10* (2006.01)
*E21B 33/14* (2006.01)

(58) Field of Classification Search
USPC ..... 166/373
See application file for complete search history.

(56) References Cited

U.S. PATENT DOCUMENTS

| | | | | |
|---|---|---|---|---|
| 5,343,954 | A * | 9/1994 | Bohlen | E21B 23/06 166/124 |
| 5,390,737 | A | 2/1995 | Jacobi et al. | |
| 2007/0119600 | A1* | 5/2007 | Slup | E21B 33/134 166/387 |
| 2015/0285026 | A1 | 10/2015 | Frazier | |

OTHER PUBLICATIONS

International Search Report and Written Opinion for International Application No. PCT/GB2016/054031 dated Feb. 16, 2017, 16 pages.
International Preliminary Report on Patentability for International Application No. PCT/GB2016/054031 dated Jul. 5 26, 2018, 9 pages.
Halliburton Drillable Service Tools, pp. 3-1 to 3-52, date unknown.

* cited by examiner

SQUEEZE PACKER AND METHOD OF SETTING A SQUEEZE PACKER

The present invention relates to a squeeze packer assembly and a method of setting a squeeze packer in an oil or gas well without the need for any additional full gauge running or mechanical setting tools.

BACKGROUND

Squeeze cementing is the term used in the oil and gas industry for the process of applying hydraulic pressure to force (or squeeze) fluid such as cement slurry into perforations, formation voids or fractures in the wellbore from surface. The cement slurry forms a filter cake in the annulus between the outside of the casing and the formation, creating a barrier and preventing fluid movement. Squeeze cementing is a common type of remedial (secondary) cementing which is especially beneficial in correcting well defects such as casing leaks due to corrosion or repairing a primary cement job which has failed.

In addition, squeeze cementing is used when an oil-producing zone is to be isolated from a neighbouring gas zone to improve the gas/oil ratio, thus resulting in an increase in oil production. Additional applications of squeeze cementing include sealing off low pressure zones that attract oil, gas or drilling fluids. Squeeze cementing is also used to seal off perforations or to plug a depleted open hole producing zone. This helps prevent fluid migration to and from the abandoned zone.

Furthermore, squeeze cementing is used for annular casing to casing or casing to formation zonal isolation during well abandonment, for example, when the cement bond on the outside of the casing has been found to be poor. A squeeze packer allows squeeze cementing operations to take place through the packer via a stinger providing a conduit through the packer through which cement is injected. By utilising a running/setting tool, a sleeve in the squeeze packer can be manipulated to control flow allowing cementing to take place through the packer before manipulating again to isolate the wellbore below the packer. In addition to this, the squeeze packer tool may be designed to be removed from the well by the use of common oil well drilling equipment and practices.

An example of a squeeze packer is the EZ SV Squeeze Packer from Halliburton, described in U.S. Pat. No. 5,390,737, which is incorporated herein by reference and is useful for understanding the claimed invention. This squeeze packer is deployed into the wellbore with a setting tool on a length of tubing such as drill pipe, and which has a sliding valve opened or closed by a series of rotations and reciprocation of the drill pipe to open and close the conduit through the packer. Great care is required to prevent premature setting of the squeeze packer. If prematurely set, the squeeze packer must be drilled out resulting in loss of time and money to the operator.

SUMMARY

According to the present invention there is provided a squeeze packer assembly for deployment in a wellbore of an oil, gas or water well on an elongate member, the squeeze packer assembly comprising

- a body having a bore, at least one anchoring member actuable between active and inactive configurations in response to changes in fluid pressure, and wherein in the active configuration, the anchoring member is adapted to anchor the body in the wellbore to resist axial movement of the body in the wellbore, and a sealing member adapted to seal an annulus between the body and an inner surface of the wellbore;
- a stinger adapted for connection to the elongate member for injection of a fluid through the packer;
- a latch adapted to releasably latch the stinger onto the body; and
- a valve selectively actuable to open and close the bore to allow and prevent fluid passage through the body, wherein the valve controls passage of pressurised fluid to the anchoring member to actuate the anchoring member between inactive and active configurations, and wherein the valve is controlled by axial movement of the stinger and the elongate member relative to the body to actuate the valve between different actuation configurations.

The stinger can optionally be disconnected from the packer by means of the latch. Optionally the latch forms part of the valve, and is adapted to releasably latch the stinger onto the valve. Optionally the valve is a sliding sleeve valve and comprises a sleeve that is adapted to slide axially in the body to open and close the bore. Optionally the stinger can be received in the bore of the body and provides a fluid conduit between the elongate member, which optionally has a bore delivering fluid to the packer, and the bore of the body of the packer, for example, when the body is anchored in the wellbore and the annulus is sealed. The bore of the body of the packer optionally delivers the fluid to the wellbore in the region of the packer, e.g. below it.

The invention also provides a method of injecting a fluid into a wellbore of an oil, gas or water well, the method comprising:

- deploying a squeeze packer into the wellbore, the squeeze packer comprising:
  - a body with a bore, at least one anchoring member actuable between active and inactive configurations in response to changes in fluid pressure, and wherein in the active configuration, the anchoring member is adapted to anchor the body in the wellbore to resist axial movement of the body in the wellbore, and a sealing member adapted to seal an annulus between the body and an inner surface of the wellbore;
  - a stinger adapted for connection to the elongate member for injection of a fluid through the packer, the stinger being releasably latched onto the body; and a valve selectively actuable to open and close the bore to allow and prevent fluid passage through the body;
- the method including:
  - anchoring the squeeze packer in the wellbore and sealing the annulus between the body and the inner surface of the wellbore; and
  - moving the stinger axially within the body to actuate the valve between different actuation configurations.

Optionally the valve can be actuated to control passage of pressurised fluid to the anchoring member to actuate the anchoring member between inactive and active configurations.

Optionally the valve can be controlled by axial movement of the stinger and the elongate member relative to the body to actuate the valve between different actuation configurations.

The claimed combination of features permits the integration of the setting tool functions into the packer assembly, so certain examples allow deployment of the packer without requiring additional full gauge running/mechanical setting tools to set, reducing the risk of premature setting of the packer while being lowered in the wellbore. In addition, the packer can be set and fluid can be injected in a single trip into the well, avoiding multiple trips required by a separate setting tool and injection string.

Optionally, the stinger can have a smooth OD adapted to minimise cement disturbance when pulling out of the hole once the packer is set and cement has been injected.

Optionally, the assembly incorporates at least one and optionally more than one set of perforating guns, for example below the packer. This permits perforations to be formed in the wellbore to enhance the penetration of cement in the same trip as the injection of cement through the packer, allowing a broader scope of remedial cementing operations to be conducted during a single run. Additionally, the assembly can be used in a similar way to circulate behind the casing allowing recovery of oil-based mud. The assembly can optionally be used for a number of applications where communication above and below the packer may be required. Additionally, once the stinger has been removed from the packer, it can also act as a permanent plug sealing off the wellbore.

The elongate member may comprise a string of tubulars such as drill pipe or a coiled tubing, optionally having a bore for the delivery of fluid to the stinger.

The integrated setting mechanism advantageously minimises or avoids rotation or reciprocation steps previously required to set the packer, thus minimising the risk of premature setting in unintended positions in the wellbore and simplifying the setting sequence.

Optionally, the cement squeeze packer is set by a combination of hydraulic and mechanical force. Optionally, the anchoring device comprises upper and lower slips. Optionally at least one of the slips is hydraulically set by fluid diverted by the valve under the control of the stinger. Optionally, a ball is dropped from surface which lands on a ball seat within the valve. Increasing applied pressure on the seated ball can optionally shift the valve between different actuation states, and direct fluid to the upper slips and optionally simultaneously anchor the slips against the inner surface of the wellbore. Optionally, the slips incorporate ratchet devices which allow movement of the slips relative to the packer to set the slips but resist movement tending to release the slips. The first stage of setting the packer via hydraulic pressure under the control of the operator reduces the risk of prematurely setting the packer by rotating or reciprocating the drill string.

Optionally a second stage of the setting sequence includes an over-pull on the elongate member to set the lower slips.

Optionally, the sealing member comprises an elastomeric element. The elastomeric element is optionally compressed axially and expanded radially against the inner surface of the wellbore by setting the anchoring member, having at least one contact portion adapted to engage with the inner surface of the wellbore. Optionally, the contact portion may comprise a plurality of ribs adapted to provide optimised friction and/or for sealing engagement with the wellbore wall. This provides the advantage that the contact surface between the inner surface of the wellbore wall or inner surface of the wellbore casing/liner string and the outer surface of the cement squeeze packer is maximised. In addition, the elastomeric element is optionally capable of conforming to the profile of the wellbore wall, therefore providing an optimised sealing engagement between the wellbore and the packer. Advantageously, the element may be formed of a polymeric material. Polymeric material such as natural or synthetic rubber, silicon, PVC or any other suitable polymeric compound may be used, because the elastic properties allow recoverable deformation that is strong enough to withstand the stresses occurring during deployment and is readily available.

Optionally, the stinger is connectable to the elongate member. Optionally, the stinger has a slick outer diameter to minimise cement disturbance while being axially pulled out of the wellbore after cementing operations. Optionally, the latch may comprise a recessed profile on an outer surface of the stinger which latches onto the valve and allows the stinger to manipulate the valve by axial movement of the elongate member. Optionally, the stinger can be released from the packer by right-hand rotation of the elongate member relative to the body.

Optionally when the squeeze packer has been set in the wellbore, the stinger, which is connectable to the elongate member string, is retracted from the packer. To release the stinger from the packer, the stinger is optionally rotated clockwise via the elongate member in conjunction with axially pulling the elongate member upward in the wellbore. As the stinger is removed from the cement squeeze packer, the valve adopts a position which closes the bore and prevents fluid movement through the packer body. Optionally, the stinger is able to axially reciprocate in and out of the packer an unlimited number of times, opening and closing the valve. Optionally, when the stinger inserted into the bore, the valve adopts an open position permitting fluid passage through the bore, which is useful to prevent surging and other undesirable hydraulic effects when moving the assembly axially in the wellbore, for example, when running into the hole.

Optionally, the valve is adapted to be selectively connected and disconnected from the stinger by axial reciprocation of the elongate member. This provides the advantage that the operator is in full control in manipulating the valve.

Optionally, the latch may optionally comprise a collet having a plurality of fingers. The number of fingers may be varied depending on various factors such as the force required to engage or disengage from the latch. The fingers may be manufactured from a resilient material such as spring steel where it is flexible enough to open to a larger diameter to receive and release the stinger. The latch may be positioned in and able to axially reciprocate inside a cylindrical sleeve. The cylindrical sleeve may have a series of internal profiles with varying diameters to allow the fingers to radially compress and relax. The fingers are optionally compressed by the interaction of shoulders positioned on the fingers interacting with profiles on the sleeve. The outwardly projecting shoulders on the fingers are optionally biased radially inwardly by the profiles on the cylindrical sleeve.

The valve may optionally have a ball seat. The ball seat can optionally be compressible or collapsible, or expandable to release the ball. Optionally, the ball seat may be profiled in such a way where a ball (which can optionally be metal or polymeric e.g. steel or phenolic) can be dropped from surface and land on the profile where it is prevented from travelling further through the packer. The profile may be a set of inwardly projecting shoulders on the collet, optionally tapered. A set of outwardly projecting shoulders are optionally located on the valve optionally at the same axial position on the valve as the inwardly projecting shoulders. When placed in the cylindrical sleeve, the internal diameter of the sleeve in which the valve is axially moveable optionally applies a force acting inwards on the outwardly projecting shoulder forcing the fingers to radially compress resulting in a reduced diameter on the profile to seat the ball. The ball seat is optionally profiled such that when under compression, the tapered inwardly projecting shoulders forming the ball seat radially compress inwards and seal against each other. When the ball lands on the seat, applied pressure from surface builds above the ball. This provides the advantage that the squeeze packer can be set using hydraulic pressure and does not rely on any mechanical movement such as reciprocation or rotation of the drill string/tubing.

When the valve is axially moved, it optionally passes through a larger diameter in a housing sleeve and the outwardly projecting shoulders are allowed to radially spring outwards back to a resting configuration. Advantageously, at this point the ball seat profile has an internal diameter larger than the external diameter of the ball. This allows the ball to fall through the valve and provide a path for fluid flow.

Optionally the valve comprises a sleeve.

In one example, the sleeve can have a first diameter and a second diameter. Optionally the sleeve can move relative to a valve closure. Optionally the valve closure can comprise a seat (such as a ball seat) and a closure member (such as a ball adapted to seat on the seat and close a fluid pathway. Optionally the fluid pathway can be an annular pathway past the valve closure, e.g. past the seated ball. Optionally the seat can remain static within the housing, and the sleeve can move (e.g. slide axially) relative to the static seat.

Optionally the sleeve can have a latch e.g. with a plurality of fingers on the sleeve. Optionally the internal diameter of the sleeve is larger towards the lower end of the sleeve. The ball seat can be disposed on a pillar in the bore of the packer. The pillar can be secured within the bore. Optionally when the packer is set, and the sleeve slides axially upwards, the larger internal diameter within the lower end of the sleeve allows fluid communication between the bore of the stinger and the sealed annulus below the packer, optionally flowing through an annular fluid bypass around the pillar and out through the circulation ports of the packer.

Optionally, the body comprises a guide which guides the stinger into the bore. The guide is optionally in the form of a funnel, having a larger diameter at an upper end tapering down to a smaller diameter at the lower end, and is optionally concentric with the bore in the body. The guide funnels the stinger into the bore to engage with the valve, which is optionally also co-axial with the bore. Advantageously, the guide is used to guide the alignment of the stinger with the valve and the bore.

To restrict fluid communication above and below the valve, a set of circumferential seals are optionally disposed on the valve, optionally between the valve and the housing sleeve in which it moves axially between different actuation configurations. The seals optionally comprise a polymeric material. Polymeric material such as natural or synthetic rubber, silicon, PVC or any other suitable polymeric compound may be used, because the elastic properties allow recoverable deformation that is strong enough to withstand the stresses occurring during axial reciprocation of the sliding valve latch.

Optionally, the packer has a secondary release mechanism. If rotation of the tubing is not possible, likely in deviated wells, a secondary release mechanism allows the packer to set while allowing release of the stinger. Optionally, the secondary release mechanism comprises an arrangement of shear pins between body portions. Optionally the shear pins comprise a brass alloy. Optionally, if the shear rating is to be greater a steel alloy can be used. A grooved profile on an upper setting sleeve acts as a shear point. Optionally the shear pins are cylindrical. Optionally, spring roll pins can be used.

Optionally, the packer is fabricated from a material which is easily drillable such as cast iron (or similar). Advantageously, this allows for drilling or milling should the packer require to be drilled out.

The built-in setting/running tool removes the need for a separate full gauge setting/running tool.

The packer optionally has a sliding valve which is able to axially slide into 2 positions, open or closed, used to allow and prevent fluid flow through the packer comprising a plurality of resilient fingers optionally made from a resilient material and providing a pressure retaining means for activating the upper slips, wherein the valve has a latch for releasably connecting to the stinger, so that optionally the stinger is selectively dis-connectable from the cement squeeze packer. Optionally, each finger on the valve has an inwardly projecting cylindrical shoulder positioned in the middle of said fingers so when they are radially compressed inwards, the projecting shoulders combine together and a reduced internal diameter is created for a valve closure member such as an activation ball (e.g. steel or phenolic) to land on and a pressure retaining seal is formed for applied pressure. Optionally the applied hydraulic pressure after the ball lands on the profile builds up to a sufficient amount which is enough to activate and set the top slips. Optionally the inwardly projecting shoulders located on the fingers are flexible enough to compress inwards, creating a ball seat profile so when the ball lands on the profile it forms a hydraulic pressure retaining seal to prevent pressure from passing through into the downwards portion of the valve. Optionally the inwardly projecting shoulder also has a matching outwardly projecting shoulder. Optionally the inwardly protruding shoulders creating the ball seat can be formed in a separate sleeve or pillar, which optionally prevents fluid bypass once a valve closure member is seated to allow hydraulic pressure to build up. Optionally the valve is positioned inside a profiled cylindrical sleeve and the cylindrical sleeve has internal profiles with different diameters and when assembled together, the sliding valve is able to reciprocate axially relative to the cylindrical sleeve and into the different profiles by the stinger. Optionally the cylindrical sleeve profiles allow the outwardly projecting shoulder on the sliding valve to compress and expand back to relaxed state depending on the position within the cylindrical sleeve. Optionally the fingers on the valve have another set of inwardly and outwardly projecting shoulders on the upper extremities of the sliding valve fingers. Optionally the inwardly projecting shoulder is profiled to match a recessed profile on a stinger which is selectively dis-connectable from the squeeze packer. Optionally the inwardly projecting shoulder is in constant contact with the matching recessed profile on the stinger by a constant bias force provided by the outwardly projecting shoulder and the profiled cylindrical sleeve. Optionally the profiled cylindrical sleeve has an internal diameter slightly larger than the compressed outwardly projecting shoulder to allow a clearance gap for the valve to axially reciprocate. Optionally the fingers on the valve are manufactured from a resilient material and are adapted to compress inwards and spring back to its original relaxed state by having good memory properties, materials such as but not limited to spring steel. Optionally once the valve has moved axially upwards with respect to the position of the cylindrical sleeve and the outwardly projecting shoulder on the valve has passed through to a larger internal diameter on the cylindrical sleeve, the fingers can spring back to a relaxed state resulting in the diameter of the inwardly projecting shoulder opening up and allowing the ball to fall through downwards. Optionally once the ball has passed through the inwardly projected shoulder of the ball seat and subsequently the valve, fluid flow is allowed between the annulus above and below the cement squeeze packer. Optionally in the pillar arrangement, once the valve has moved axially upwards, a change in internal diameter allows fluid to bypass around the ball and out the circulation ports. Optionally further axial movement of the sliding valve latch within the mandrel results in the stinger being fully released from the squeeze packer. Optionally the valve is axially moved in the upwards direction after the hydraulic setting of the upper slips has taken place. Optionally the lower slips of the packer are set mechanically by over pull of the drill pipe/tubing. Optionally the mechanical over pull of the lower slips compresses an elastomeric element which can be but not limited to an elastomeric or polymeric compound. Optionally the element is compressed radially outwards having a contact portion adapted to engage with the wall of the wellbore. Optionally the compressed element is capable of retaining wellbore fluid/pressure from bypassing. Optionally the stinger has an open-ended profile to allow cementing operations to take place once released from the squeeze packer. Optionally the stinger has a slick outer diameter to minimise cement disturbance when it is released from the cement squeeze after cementing operations has taken place. Optionally the stinger is released from the squeeze packer by right-hand rotation of the drill pipe/tubing. Optionally the tubing is pulled axially upwards resulting in the sliding valve latch fingers entering a larger internal diameter in the cylindrical sleeve and releasing from the stinger. Optionally once the stinger is removed from the squeeze packer the valve latch closes off fluid flow/communication between the upper and lower annulus in the wellbore between the packer. Optionally fluid flow/communication is prevented by misaligning circulation ports on the sliding valve and cement end cap by axially moving the sliding valve. Optionally once the ports are misaligned by axial movement of the sliding valve, a set of radial seals retain and prevent fluid flow/communication. Optionally a pressure test can be performed above the cement squeeze packer confirming well integrity. Optionally the stinger can be lowered back into the squeeze packer once a pressure test is complete to latch onto and re-open the sliding valve and allow fluid flow/communication above and below the annulus in the wellbore between the packer. Optionally remedial cementing operations can take place once the recessed profile on the stinger re-latches onto the inwardly projecting shoulder on the sliding valve. Optionally the fingers of the sliding valve and inwardly projecting shoulders are resilient enough to expand to receive the stinger and spring back to its relaxed state once the inwardly projecting shoulder meets the matching recessed profile on the stinger. Optionally the sliding valve is pushed downwards and circulation ports on the sliding valve align with ports on the cement end cap to allow fluid flow through the drill string/tubing and out the wellbore annulus below the packer. Optionally a set of seals divert fluid/pressure from the stinger out through the circulation ports on the sliding valve latch and cement end cap.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the spirit and scope of the present invention. Accordingly, each example herein should be understood to have broad application, and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. In particular, unless otherwise stated, dimensions and numerical values included herein are presented as examples illustrating one possible aspect of the claimed subject matter, without limiting the disclosure to the particular dimensions or values recited. All numerical values in this disclosure are understood as being modified by "about". All singular forms of elements, or any other components described herein are understood to include plural forms thereof and vice versa.

Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

References to directional and positional descriptions such as upper and lower and directions e.g. "up", "down" etc. are to be interpreted by a skilled reader in the context of the examples described to refer to the orientation of features shown in the drawings, and are not to be interpreted as limiting the invention to the literal interpretation of the term, but instead should be as understood by the skilled addressee. In particular, positional references in relation to the well such as "up" and similar terms will be interpreted to refer to a direction toward the point of entry of the borehole into the ground or the seabed, and "down" and similar terms will be interpreted to refer to a direction away from the point of entry, whether the well being referred to is a conventional vertical well or a deviated well.

DETAILED DESCRIPTION

Figure 1:
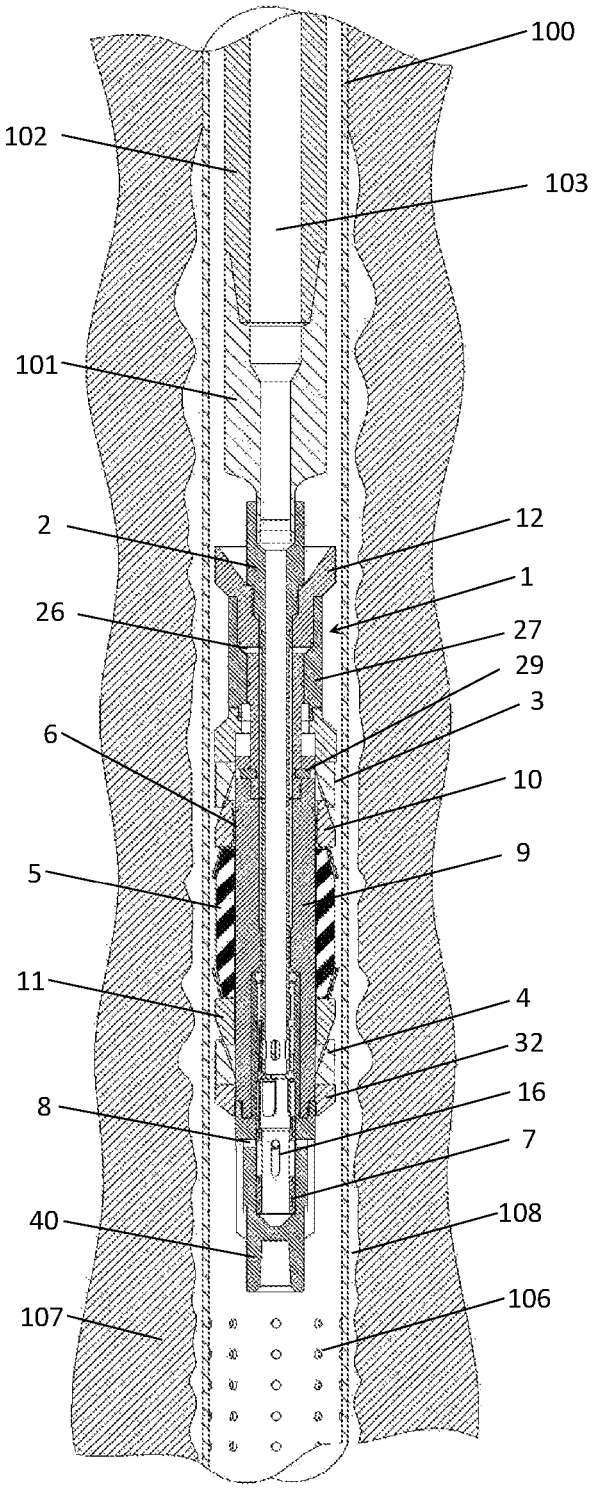
FIG. 1 shows a schematic sectional front view of a packer in the 'running in' position as it is lowered into the wellbore.

FIG. 1 shows a cross-section view of a first example of a squeeze packer assembly comprising a packer 1 and a stinger 2; in this example, the packer 1 is a cement squeeze packer. In FIG. 1 the packer 1 is connected to tubing 102 (which could be drill pipe) via the stinger 2 and a crossover 101. The tubing 102 has a bore 103. The packer assembly is deployed in a wellbore 100 drilled in a formation 107 and cased by metal casing or similar. In this wellbore, the cement job has deteriorated forming an annulus 108 between the casing and the wellbore 100, which is to be repaired using the packer assembly. The packer 1 is lowered into the wellbore 100 via tubing 102 to the required setting depth, in this example, just above lower perforations 106 formed through the casing, optionally in an earlier trip. The stinger 2 is coupled to the crossover 101 via a standard oilfield connection (e.g. a box and pin arrangement having a conventional right hand thread).

The packer 1 has a body comprising a central mandrel 9 having a central bore 9*b*. The mandrel 9 has a socket at its upper end which receives a lower stem of an upper setting sleeve 12, also having a bore which is co-axial with the bore 9*b* of the mandrel 9. The upper setting sleeve 12 is connected to the mandrel 9 via shear pins 29 passing radially through the socket and into the stem. Above the stem, the upper section of the upper setting sleeve 12 has a guide in the form of a funnel which tapers radially inward from a wide diameter opening at the top of the funnel to a narrow throat at the junction between the upper section and the stem of the upper setting sleeve 12. The throat is co-axial with the bore of the upper setting sleeve 12 and with the bore of the mandrel 9, and the opening to the throat has a female thread 33 on its inner surface which has an opposite hand to the normal thread used to make up the standard oilfield connections (best seen in FIG. 9). In this example, the thread is a right hand thread, being connected by anti-clockwise rotation of a male threaded member in the bore, and being disconnected by clockwise rotation. The stem of the upper setting sleeve 12 is generally cylindrical and is surrounded by an outer setting sleeve 27, which receives the upper setting sleeve 12 in a cylindrical socket permitting sliding movement between the sleeves 12, 27. The socket is chamfered at its lower end, forming a stop to limit axial sliding of the upper sleeve 12 within the outer sleeve 27 just as the lower surface of the funnel shoulders out on the upper surface of the outer setting sleeve 27. The upper sleeve has radial ports 26 connecting the bore of the upper setting sleeve 12 with its outer surface.

The mandrel 9 is generally cylindrical, and on its outer surface, it carries anchoring and sealing members, optionally in the form of sleeves in this example, which anchor the packer in place, and seal the annulus between the packer 1 and the inner surface of the wellbore 100. Below the outer setting sleeve 27, and surrounding the interface between the upper setting sleeve 12 and the socket in the mandrel 10, is a skirt, having a radially extending flat lower surface forming a shoulder that engages an upper surface of an anchoring member in the form of an upper set of slips 3 having an inner profile with a wedge shape that cooperates with a cone 10, and an outer profile that grips the inner surface of the wellbore. The interface between the skirt and the upper slips 3 is optionally smooth, allowing the slips 3 to slide radially outwards against the skirt. The slips 3 in this example are formed as separate parts, circumferentially spaced around the outer circumference of the mandrel 9. The upper slips 3 and cone 10 are slidable axially relative to the mandrel 9, and are arranged so that axial sliding movement of the cone 10 toward the slips 3 causes the slips 3 to move radially outwards, to grip the inner wall of the wellbore 100. Below the cone 10, a sealing member in the form of an elastomeric sealing element 5 is supported between oppositely oriented seal shoes, and is optionally split into several axially separate parts. Below the elastomeric ceiling element 5, a set of lower slips 4 and corresponding cone 11 is provided having a similar configuration to the upper slips 3 and clone 10, but oriented in the opposite direction. Below the lower slips 4, an end collar 32 is mounted on the outer surface of the mandrel 9, and in this example is fixed to the mandrel 9 and cannot slide along its outer surface as the cones and slips can. At the lower end of the mandrel 9 a screw thread connection attaches an end cap 40.

The central bore 9*b* extending through the body of the mandrel 9 is counter-bored at its lower end, to a larger diameter in order to receive a valve within the bore. The upper portion of the end cap 40 connected to the mandrel 9 also has a similar diameter of bore, and together the large diameter bores of the end cap 40 and mandrel 9 allow the valve to shuttle axially by sliding within the enlarged bore in order to open and close ports 8 in the end cap 40.

The stinger 2 is received within the bore of the mandrel 9 and extends axially through the mandrel 9 into the larger bore chamber containing the valve. In this example, the body of the valve comprises a shuttle sleeve 7 having valve ports 16 in the form of slots which extend axially along the shuttle sleeve 7. Optionally four valve ports 16 are spaced circumferentially at equal spacing around the shuttle sleeve 7, at the same axial position.

The shuttle sleeve 7 is generally cylindrical and can be formed from spring steel or some other resilient material. At its lower end, the valve ports 16 are disposed above a solid section bounded by resilient circumferential seals 17 on the outer surface of the cylinder. As the shuttle sleeve 7 slides axially within the enlarged bore of the body, the seals 17 move over the circulation ports 8 extending radially through the end cap and move the valve ports 16 in and out of fluid communication with the circulation ports 8 to open and close the fluid conduit formed by the bore of the packer.

At its upper end, the shuttle sleeve 7 has a latch device in the form of a collet comprising a plurality of resilient fingers 14 connected to the end of the sleeve in a cantilever manner and extending axially from a ball seat 15. The upper end of the shuttle sleeve 7 is relatively resilient, allowing the collet fingers 14 and the ball seat 15 to move radially into different configurations as will be described below.

When run in hole, in the FIG. 1 configuration, the stinger 2 is engaged with the upper end of the shuttle sleeve 7 via the latching device provided by the collet fingers 14. The arrangement of slotted valve ports 16 on the shuttle sleeve 7 align with the circulation ports 8 on the end cap 40 thereby opening the bore through the packer and preventing surging of the well while running in. The assembly is run into the hole until it reaches the setting depth, where the perforations 106 in the wellbore 100 lead to the annulus 108 between the wellbore 100 and formation 107.

The upper and lower slips 3, 4 are set to anchor the packer in position. The upper cone 10 is mounted on a body lock ring 6 where the surface of the internal diameter of the body lock ring 6 has teeth which cooperate with teeth on the mandrel 9 to permit movement of the body lock ring relative to the mandrel 9 in one direction only. In this example it allows the mandrel 9 to move upwards with respect to the cone 10 and resists movement of the upper cone 10 relative to the mandrel 9 when the packer 1 is set.

Figure 2:
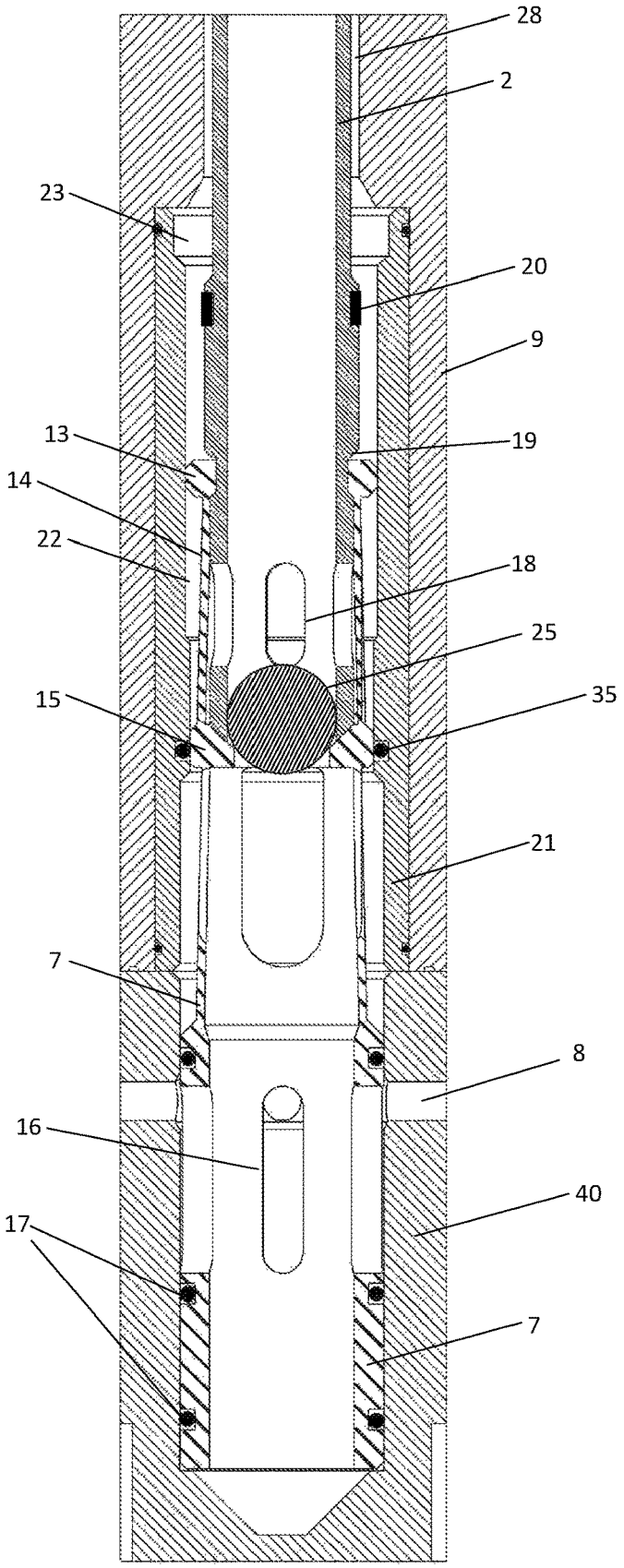
FIG. 2 shows a close up schematic sectional front view of the FIG. 1 packer showing a valve in the 'running in' position with the circulation ports aligned, a ball on a ball seat, and a stinger latched onto the valve.

The shuttle sleeve 7 is shown in more detail in FIG. 2, which shows the position after running into the hole and after an activation ball 25 has been dropped from surface and is seated on the ball seat 15 on the shuttle sleeve 7. The collet fingers 14 are flexible enough to radially expand and spring back to a resting state. Three fingers 14 are provided in this example, but optionally more fingers may be used in other examples. The collet fingers 14 have two main functions: to latch onto the stinger 2 and to provide a pressure retaining ball seat 15, which optionally releasably retains the ball 25. The stinger 2 has a recessed groove 19 on its outer surface with a profile which matches the profile on the internal surface of the tips 13 on the fingers 14. The tips 13 spread radially outwards when engaged by the chamfered end of the stinger 2 during initial assembly, and slide along the outer surface of the stinger until they reach the groove 19 above the stinger ports 18, just as the chamfered end of the stinger shoulders out on the upper face of the ball seat 15, which optionally has a complementary profile to the chamfer on the end face of the stinger 2. Once they reach the groove 19, the tips 13 close radially into the position shown in FIG. 2 and thereby latch the stinger 2 onto the upper end of the shuttle sleeve 7. The connection allows the valve to be opened and closed by axial reciprocation of the stinger. The connection between the shuttle sleeve 7 and the stinger is releasable as will be described below.

Mounted on the same collet fingers 14, a ball seat 15 is provided. The ball seat 15 is radially expandable between the seating configuration shown in FIG. 2, in which the ball 25 is retained on the seat 15, and a release position shown in FIG. 6, where the ball 25 is released and can pass through the seat 15. In the FIG. 2 arrangement, the ball seat 15 is in the compressed seating configuration with a reduced internal diameter. When the ball 25 is seated on the seat 15 in this configuration, it can occlude the bore through the packer, and seating the ball 25 on the seat 15 optionally provides a pressure retaining seal in the bore. This can be used to divert fluid in the bore 9*b* via the stinger ports 18 to activate and set the upper slips as will be described below. An annular seal 35, made from an elastomeric compound or similar optionally provides the pressure retaining seal while the ball seat 15 is in the compressed state and an activation ball 25 is seated on the seat 15. Optionally the inter-engaging faces between the segments of the ball seat 15 have a close tolerance and when compressed together in the compressed seating configuration, they resist the passage of fluid between the segments. Optionally the segments can be coated with a resilient material to enhance their sealing ability when compressed into the seating configuration.

A cylindrical valve housing sleeve 21 fixed in the bore of the mandrel 9 has a central bore that is co-axial with the bore 9*b* of the mandrel 9. The valve housing sleeve 21 houses the shuttle sleeve 7 and permits it to move axially within the bore of the valve housing sleeve 21 between different states of actuation. The valve housing sleeve 21 has a series of counter-bores forming a stepped internal profile which increases in diameter towards the upper end of the valve housing sleeve 21. Two steps are provided in the bore of the housing sleeve; namely a first step between a relatively narrow central section of the bore housing the seal 35 and an intermediate section 22 of the bore immediately above the central section, and a second step between the intermediate section 22 and an end section 23. The central section has a narrower internal diameter than the intermediate section 22, which has a narrower internal diameter than the end section 23. The internal diameter of the intermediate section 22 is sufficiently narrow to maintain the tips 13 of the collet fingers 14 compressed in the groove 19, to keep the stinger 2 latched to the shuttle sleeve 7 for as long as the tips 13 of the collet fingers 14 are in the intermediate section of the bore of the valve housing sleeve 21. However, the intermediate section 22 is sufficiently wide to permit expansion of the ball seat 15 from its FIG. 2 position. Therefore, as the shuttle sleeve 7 slides upwards and the ball seat 15 enters the intermediate section 22 of the bore, the ball seat 15 can radially spring outwards back to its original relaxed state. The internal diameter of the ball seat 15 is therefore increased and the activation ball 25 is able to fall through the relaxed ball seat 25. However, the stinger 2 remains latched onto the shuttle sleeve 7 as long as the tips 13 remain in the intermediate section 22 of the bore.

Further upwards movement of the shuttle sleeve 7 eventually moves the tips 13 of the fingers 14 into the end section 23 of the bore, which has a larger diameter than the intermediate section. The larger diameter of the end section 23 provides sufficient annular space outside the tips 13 for the tips 13 to expand radially outward, which releases the stinger 2 from the shuttle sleeve 7. Once the shuttle sleeve 7 has been pulled up to the position where the tips 13 of the collet fingers 14 expand into the end section 23, the slotted valve ports 16 are sealed off from the circulation ports 8 and fluid flow is prevented through the bore.

Figure 3:
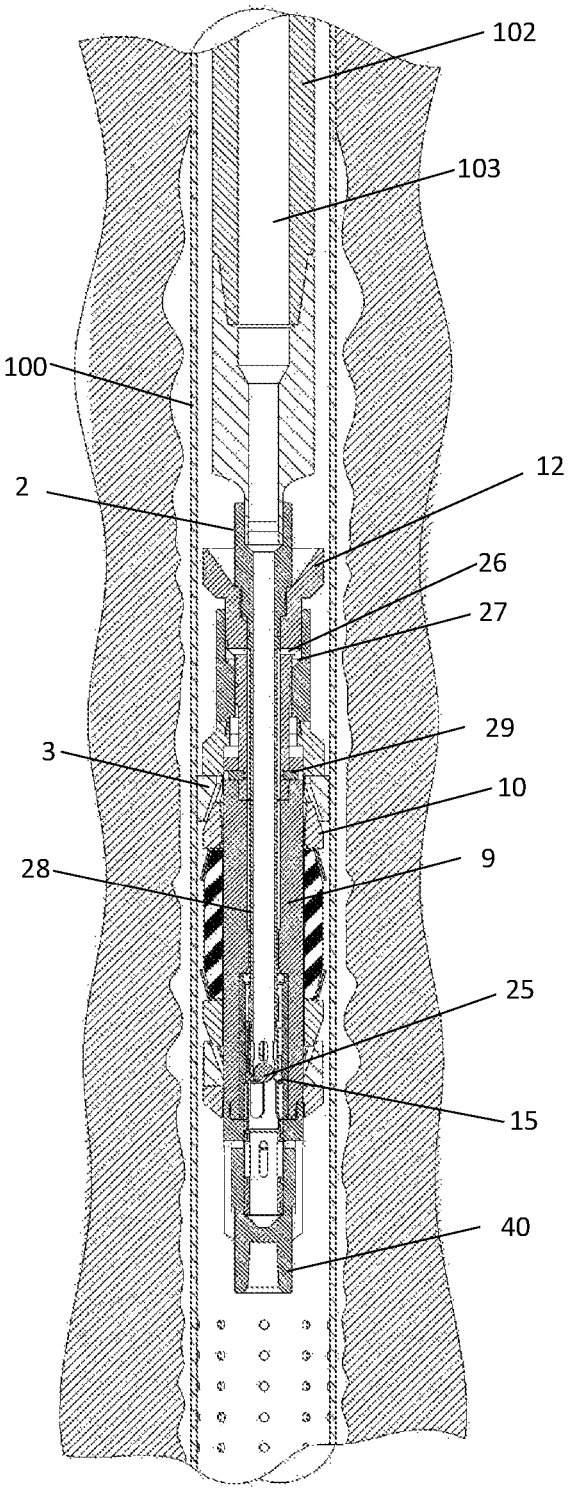
FIG. 3 shows a schematic sectional front view of the FIG. 1 packer with upper slips set by applied hydraulic pressure acting on the ball on the seat.

Now referring to FIG. 3, the activation ball 25 is dropped from surface through the internal bore 103 tubing 102, falls through the bore of the stinger 2, and eventually lands on the ball seat 15 in the shuttle sleeve 7, which is at this time in the closed position shown in FIG. 2. Pressure from surface is applied through the bore of the stinger 2 and stinger ports 18, and builds up above the seated ball 25. This pressure differential is communicated via the annulus 28 between the stinger 2 and the mandrel 9 leading to ports 26 on the upper setting sleeve 12, which communicate the pressure to the annular space between the outer surface of the upper setting sleeve 12 and the inner surface of the outer setting sleeve 27, which, as mentioned above, is axially slideable over the upper setting sleeve 12. Since the upper setting sleeve is pinned to the mandrel 9 by shear pins 29, this pressure differential applied from surface acts upon the upper face of the outer setting sleeve 27 and hydraulically forces it downwards over the upper setting sleeve 12 and mandrel 9. The skirt on the lower face of the outer setting sleeve 27 therefore urges the upper slips 3 axially downwards along the outer surface of the mandrel 9 onto the thin end of a ramped profile on the upper cone 10. As the upper slips 3 move axially along the ramped profile, they are forced to move radially outwards against the casing 100 to the position shown in FIG. 3. An anchor is then created as the slips 3 have a grooved profile cut into an outer surface which allows movement of the slips in a downwards direction (to force the slips radially outwards tighter against the wall) but prevents movement to release the slips.

Figure 4:
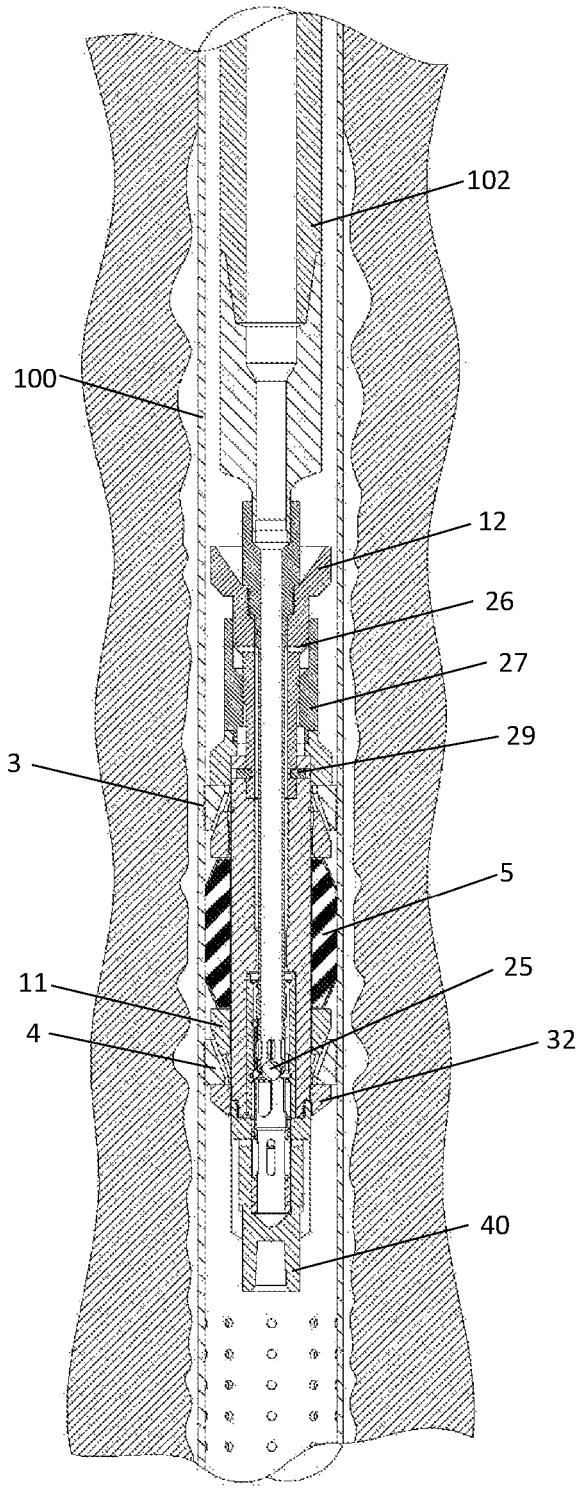
FIG. 4 shows a schematic sectional front view of the FIG. 1 packer with lower slips set by pulling the drill string/tubing upwards which also compresses the elastomeric/rubber element.

FIG. 4 shows the next stage of the setting sequence after the upper slips 3 have been set and anchored against the wellbore 100. A mechanical over pull on the tubing 102 causes the end collar 32 to pull the lower slips 4 upwards over a ramped profile on the lower cone 11 and move them radially outwards against the wellbore 100. Similar to the upper slips 3, the lower slips 4 have a grooved profile cut into an outer surface which acts as a ratchet to allow upward movement of the lower slips 4 to tighten them against the wall of the wellbore but resists movement tending to release the slips. The over pull also causes the elastomeric element 5 to compress axially and expand radially to meet the wellbore 100 and seal off the annulus between the wellbore 100 and the packer 1. The over pull is applied from the surface by pulling up on the tubing 102, which is secured to the stinger 2 by the cross over 101. The force is applied to the mandrel 9 by the threads 33, 34 connecting the stinger 2 and the upper setting sleeve 12 at the throat, and by the radial shear pins 29 connecting the upper setting sleeve 12 to the mandrel 9 in the socket of the mandrel 9.

Figure 5:
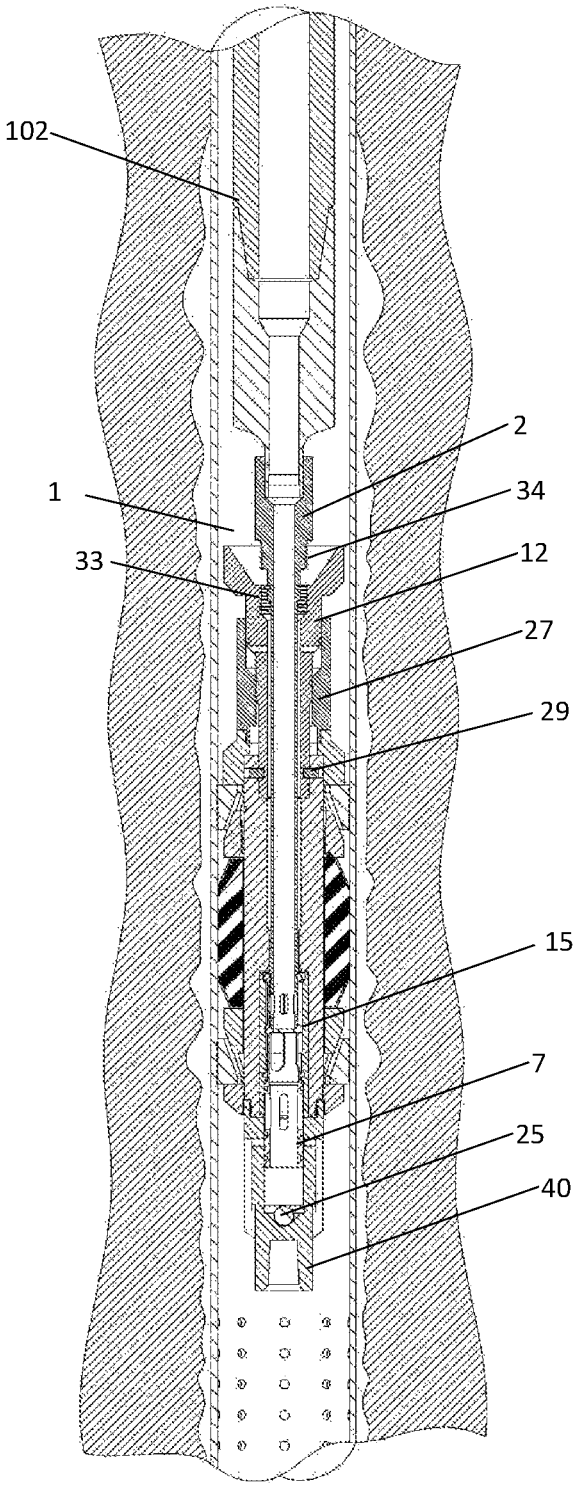
FIG. 5 shows a schematic sectional front view of the FIG. 11 packer once the stinger has disconnected from the valve which has opened up and allowed the ball to fall into a pocket.

Referring now to FIG. 5, once the upper slips 3 have been set by hydraulic pressure applied from surface through the elongate member and the stinger, and an over pull (also applied from surface via the elongate member and the stinger 2) has been applied to set the lower slips 4 and expand the elastomeric element 5, the stinger 2 can be released from the squeeze packer 1 by rotating the tubing 102 to the right (clockwise as seen from the surface) to disconnect the left-hand male thread 34 on the stinger 2 from the left-hand female thread 33 on the throat of the upper setting sleeve 12. Keeping the tubing 102 in tension while rotating helps the stinger 2 to release from the packer 1. As the stinger 2 moves up the bore **9*b* the activation ball 25 is released from the ball seat 15 as the seat 15 expands and drops into the end cap 40** as explained below.

Figure 6:
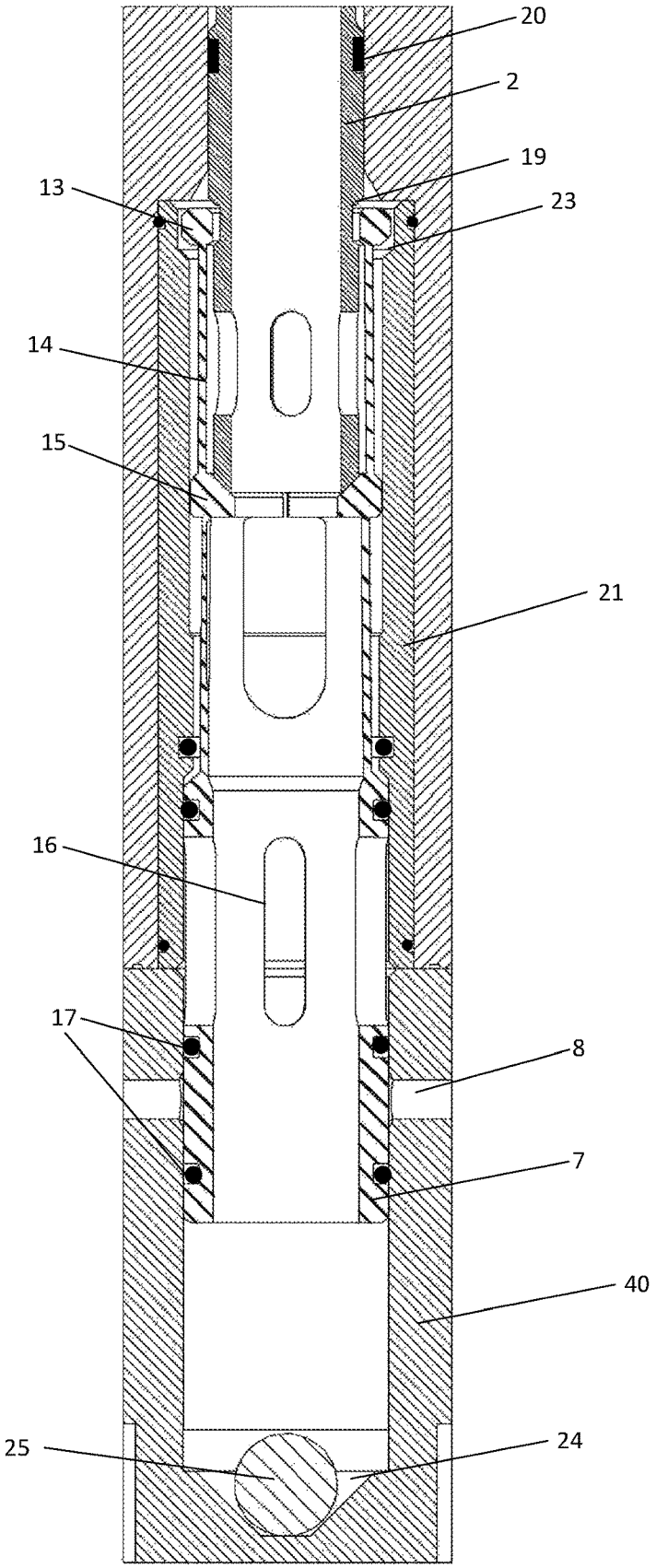
FIG. 6 shows a close up schematic sectional front view of FIG. 5 showing the valve in the closed position as the stinger has axially moved upwards and the ball falls into the pocket due to the ball seat springing back to its original relaxed state and creating a larger internal diameter than the outer diameter of the ball.

The closed position of one example of shuttle sleeve 7 is shown in FIG. 6, which is a close up view of the FIG. 5 position. As shown, the stinger 2 has moved up the bore and disengaged from the thread 33 in the throat of the upper setting sleeve 12. Since the tips 13 on the collet fingers 14 are still engaged in the groove 19 the shuttle sleeve 7 is still connected to the stinger 2 at this point, and has axially moved upwards from its original position. In the FIG. 5/6 position, the slotted valve ports 16 on the shuttle sleeve 7 are out of alignment with the circulation ports 8 which are sealed off from the bore of the packer by a circumferential seals 17 compressed between the outer surface of the shuttle sleeve 7 and the inner surface of the end cap 40, therefore preventing communication through the ports 8 and closing the bore **9*b*. Above the shuttle sleeve 7, the bore is sealed by a bonded seal 20 on the stinger 2, which prevents fluid flow from the squeeze packer to the wellbore. Thus there is no fluid communication between the bore of the stinger 2 and the wellbore in this configuration. The seals 17 and bonded seal 20** can optionally comprise a polymeric material resilient enough to retain hydraulic pressure as well as durable enough to withstand axial reciprocation.

Just before the shuttle valve 7 has axially moved upwards into the FIG. 5/6 position, the ball seat 15 traverses from the central section of the valve housing sleeve 21 into the intermediate section 22, and is no longer radially compressed by the narrower bore of the central section and so radially springs back to its original relaxed state as shown in FIG. 6 as soon as it passes the transition between the central and intermediate sections 22 on the valve housing sleeve 21. The ball seat 15 expands in the intermediate section to a larger internal diameter than the ball 25, which drops through the expanded ball seat 15 and lands in a pocket 24 in the end cap 40.

Continued upward axial movement of the stinger 2 drags the tips 13 of the fingers 14 up into the end section 23 of the valve housing sleeve 21, which has a larger internal diameter permitting the tips 13 to expand radially and escape from the groove 19 on the stinger 2. This releases the stinger 2 from the shuttle sleeve 7. Once the tips 13 are in the end section 23, the sliding valve latch 7 is free from the stinger 2 and can be pulled freely from the packer 1, leaving the tips 13 latched in the upward configuration in the end section 23. Once the stinger 2 is removed from the cement squeeze packer, additional operations such as pressure testing to confirm well integrity can be conducted. If additional adjustment of the packer is needed, the stinger 2 can be re-engaged with the packer and adjustments made as many time as are needed, without pulling the string from the hole. Optionally, cementing operations take place only after the stinger has disconnected from the packer and re-engaged as described. Optionally, the stinger is disconnected from the packer after setting before being able to open and close the valve.

Figure 7:
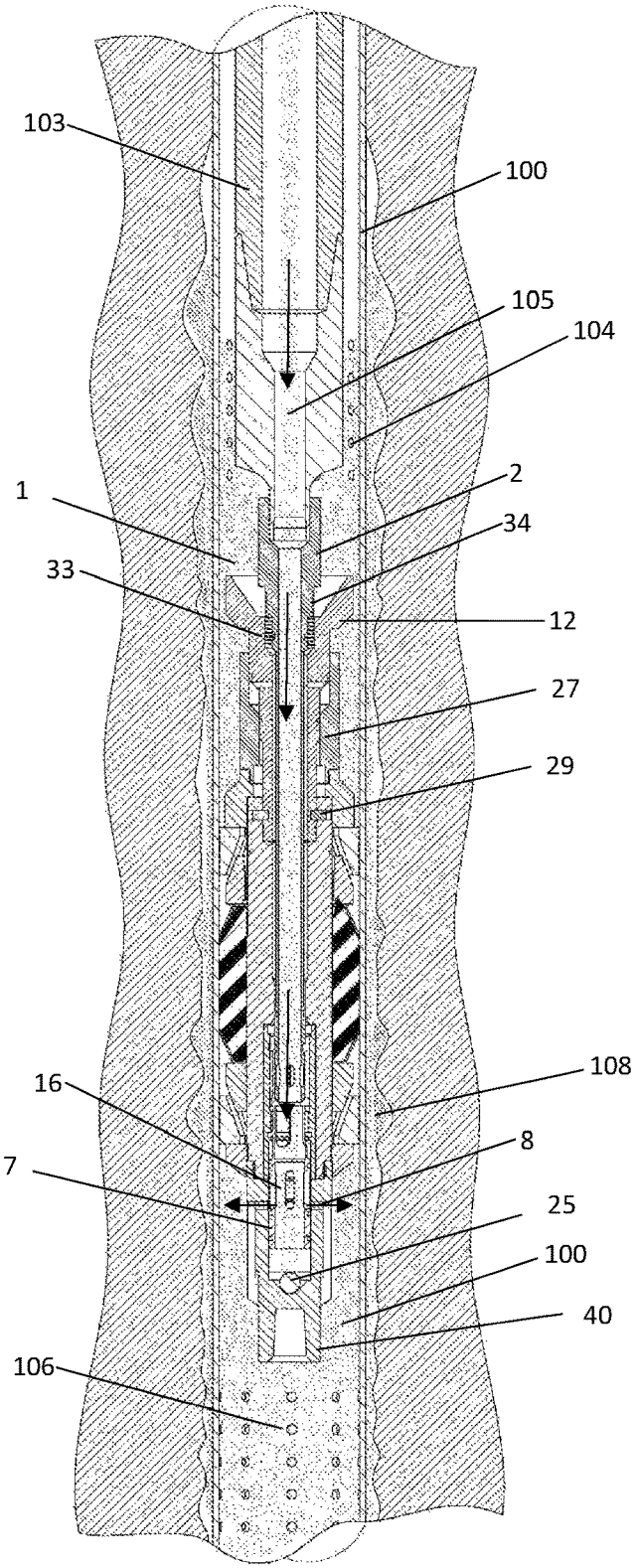
FIG. 7 shows a schematic sectional front view of the FIG. 1 packer with the stinger lowered back into the packer and cement displaced through the tubing, out the circulation ports into the wellbore and into the perforations.

In the configuration shown in FIG. 7, the stinger 2 has been lowered back into the wellbore 100 via tubing 102 back into the cement squeeze packer 1 after completion of pressure testing. In the present example, upper perforations 104 have been made in the wellbore 100 after the squeeze packer 1 has been set and before lowering the stinger 2 back in the wellbore 100; in some examples, the perforations have been pre-formed. The present example shows the stinger 2 fully engaged back into the cement squeeze packer 1 after the FIG. 5 configuration. To achieve this, the stinger 2 is lowered through the funnel at the top of the upper setting sleeve 12 into the bore of the body, and the threads 33, 34 are made up by anticlockwise rotation applied to the tubing 102 from the surface. Optionally, a physical no-go is provided by the male thread 34 on the stinger and female thread 33 on the upper setting sleeve 12, resisting further axial travel of the shuttle sleeve 7 further into the bore of the mandrel 9. As the stinger 2 is lowered through the bore of the body, the lower end of the stinger 2 eventually shoulders out on the ball seat 15 as shown in FIG. 6, which pushes the shuttle sleeve downwards in the bore, causing the tips 13 to compress radially inwards as they leave the end section and re-engage in the groove 19 on the outer surface of the stinger 2 thereby reconnecting the stinger 2 and the shuttle sleeve 7 via the latch provided by the collet fingers 14. The end of the stinger 2 is chamfered to match the profile of the ball seat 15, which cannot expand (because it is still in the relatively narrow intermediate section 22) and so the ball seat 15 is pushed axially by the advancing stinger 2 down the intermediate portion 22 of the housing sleeve.

Once the stinger 2 and shuttle valve 7 have fully engaged and the shuttle sleeve has moved down to the FIG. 7/8 position, the valve ports 16 at the lower end of the shuttle sleeve 7 line up with the circulation ports 8 providing fluid communication between the tubing 102 and the wellbore 100 through the stinger 2 and shuttle sleeve 7. Cementing operations can then begin through the lower perforations 106. Cement 105 is pumped through the bores of the tubing 102, crossover 101, stinger 2, packer 1 and out of the circulation ports 8. Once the cement 105 enters the lower wellbore 100 below the packer 1, it fills the lower wellbore and flows through the lower perforations 106 into the annulus 108 between the wellbore 100 and formation 107. The cement 105 enters and fills up any fractures and voids which may be present before reaching the upper perforations 104 and flowing through the upper perforations into the upper section of the wellbore 100 above the packer 1.

Figure 8:
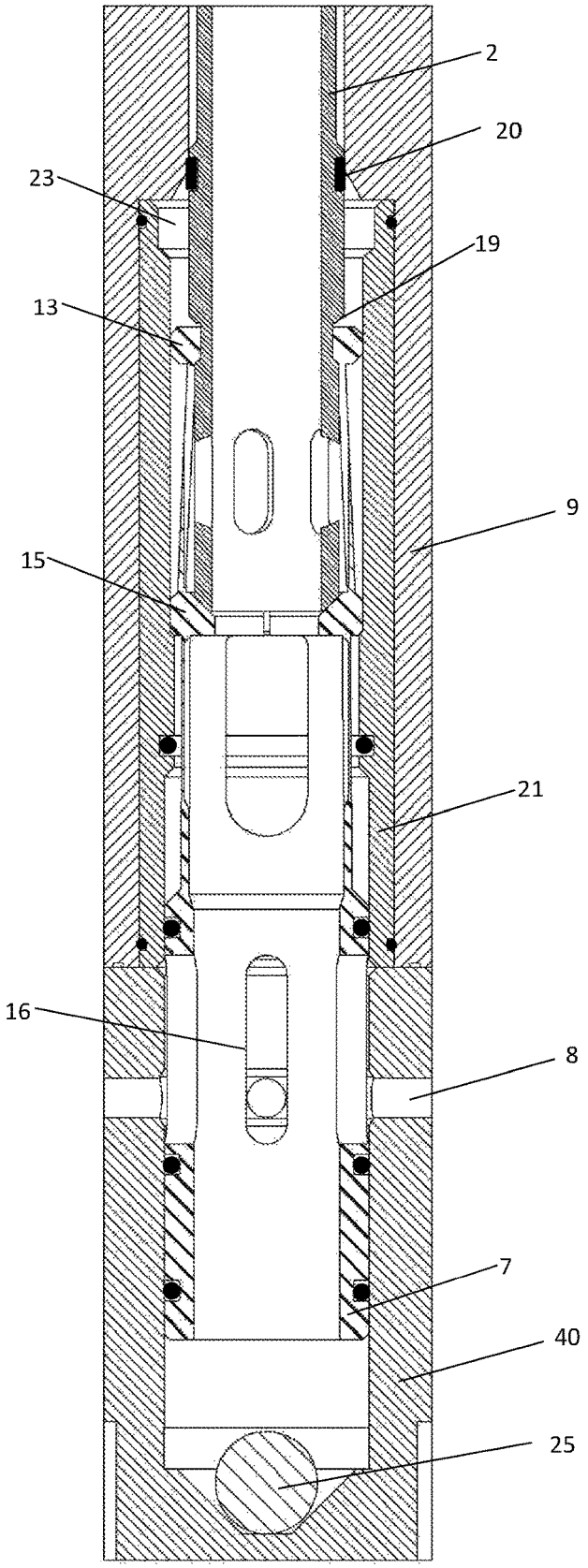
FIG. 8 shows a close up schematic sectional front view of the FIG. 7 position with the valve in the open position after the stinger has lowered and latched onto the valve, allowing fluid flow through the aligned circulation ports.

FIG. 8 shows the position of the shuttle valve 7 after the stinger 2 has been lowered back in the wellbore and is engaged back into the packer 1. The stinger 2 enters the shuttle sleeve 7, expands the tips 13 and shoulders up against the ball seat 15. The protruding finger profiles 13 locate into the recessed profile 19 on the stinger 2. Further axial downwards movement from the stinger 2 compresses the tips 14 radially inwards until firmly engaged in the end section 19 thereby re-latching the shuttle sleeve 7 back onto the stinger 2, and allowing the shuttle sleeve 7 to move further into the cylindrical sleeve 21. The tips 13 are tapered to match the internal profile of the end section 23 so do not cause interference. When the stinger 2 is fully engaged, in the FIG. 7 position, the valve ports 16 are aligned with the circulation ports 8 and the sliding valve 7 is in the open position allowing fluid movement.

Figure 9:
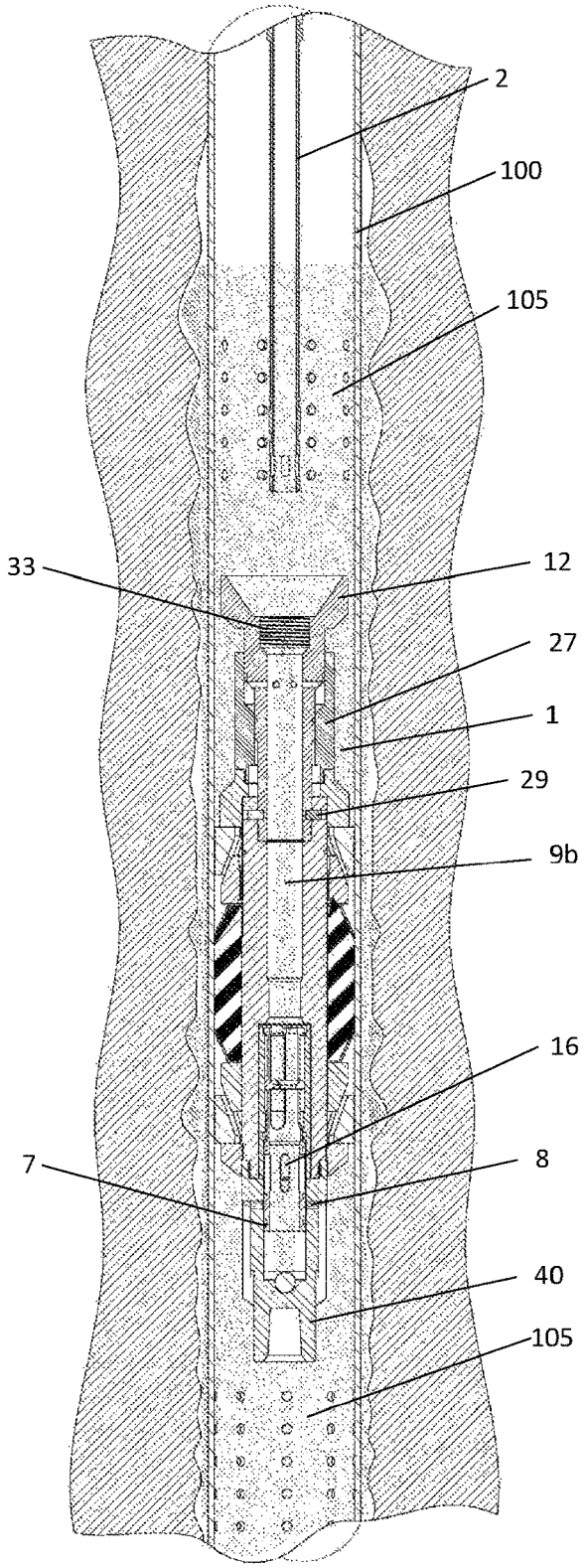
FIG. 9 shows a schematic sectional front view of the FIG. 1 packer after remedial cementing has taken place with the stinger released from the squeeze packer and thus closing the valve, retaining the cement.

FIG. 9 shows the stinger 2 axially withdrawn from the cement squeeze packer 1, after cementing operations have been completed. Once the cementing operation is completed, the stinger 2 is withdrawn from the wellbore 100. The shuttle sleeve 7 is axially moved upwards and prevents fluid movement by misaligning the circulation and valve ports 8, 16, sealing off the ports 8 by the lower sealed portion of the shuttle sleeve 7 and retaining the cement 105 in place. The stinger 2 is then fully retracted back to surface after displacing the cement 105. Optionally the outer surface of the stinger 2 is relatively smooth and causes minimal disruption to the setting cement 105.

Figure 10:
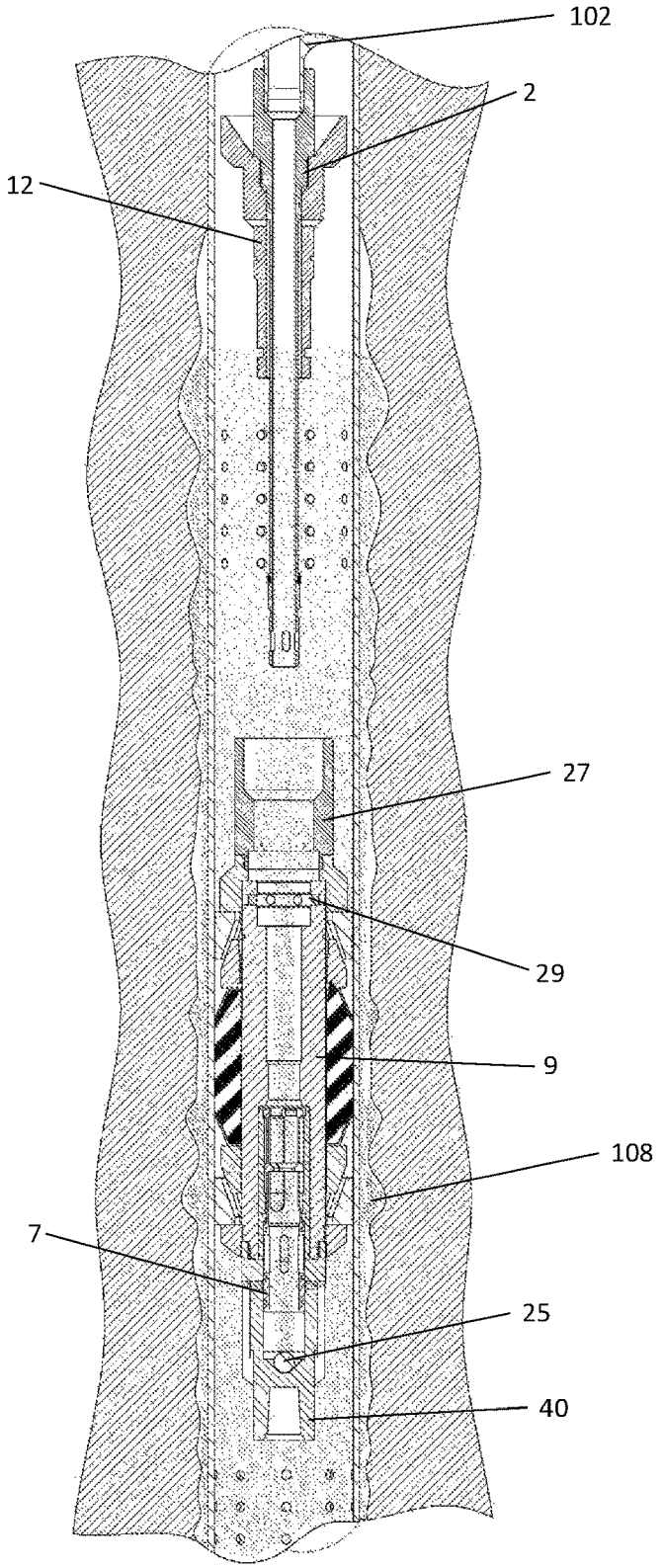
FIG. 10 shows a schematic sectional front view of an alternative release method where the stinger is released from the packer by over pull on the drill string/tubing and shearing a set of shear pins at a predetermined value.

In FIG. 10, an optional secondary release mechanism of the packer is shown, used in the event of sticking of the threads 33, 34. In the optional secondary release mechanism, shear pins 29 connecting the mandrel 9 with the upper setting sleeve 12 are sheared by mechanical over pull of the tubing 102 applied from surface. A predetermined shear valve is set before the squeeze packer is run in hole. Optionally the shear pins 29 are brass or can be formed from other materials such as steel if higher thresholds of shearing are needed. If right-hand rotation of the tubing 102 to release the stinger 2 from the packer 1 is not possible, mechanical over pull of the tubing 102 from surface can be performed. The shear pins 29 have a predetermined shear value. Once released, the upper setting sleeve 12 is kept engaged with the stinger 2 while still allowing an open ended profile of the stinger 2 for cementing through.

Figure 11:
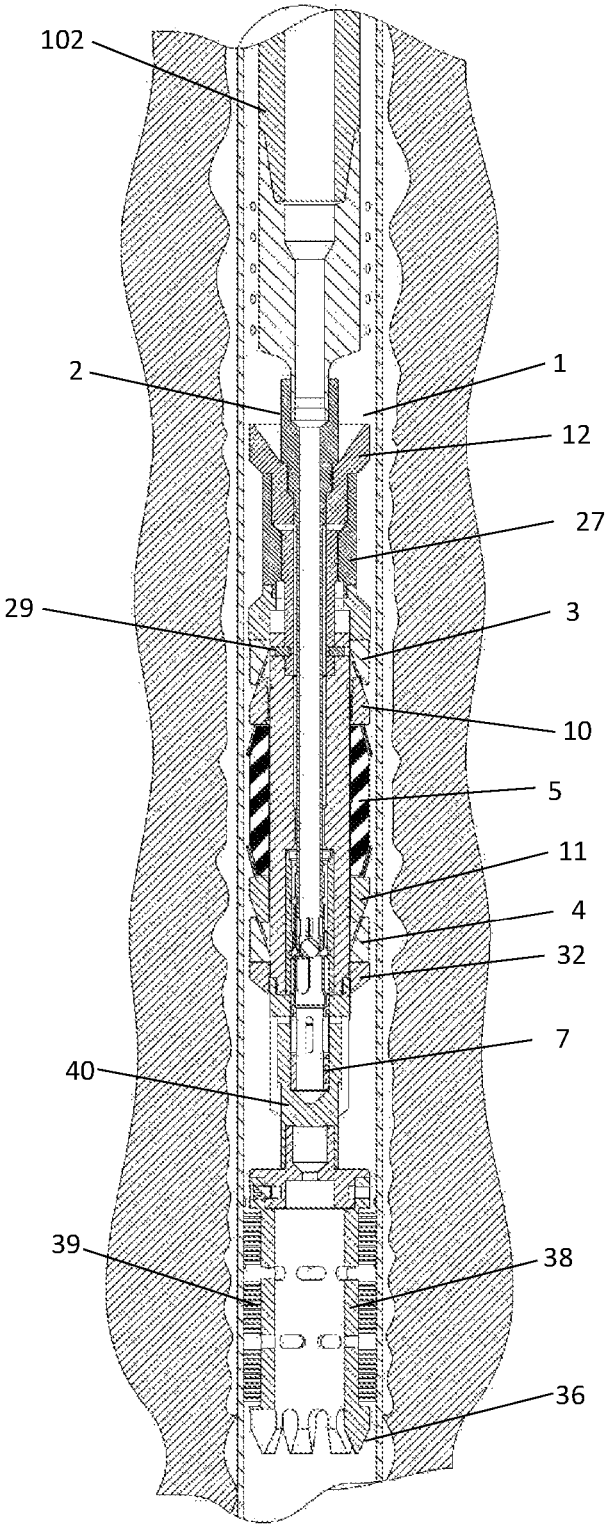
FIG. 11 shows a schematic sectional front view of an alternative example where a disposable cleaning element, in this case a brush, is attached to the bottom of the packer and used to clean the setting area and the micro annulus to allow an optimised sealing engagement between the wellbore and the packer.

FIG. 11 shows an optional modification to the above-described example, where a cleaning tool, in this case a disposable brush 36 is connected to the end of the packer 1 via the end cap 40. This allows the setting area around the perforations 106 to be cleaned of debris and to remove any accumulated micro annulus formed between layers of mud etc. in the wellbore which may cause setting problems with the cement. The disposable brush 36 or similar is optionally manufactured from drillable material such as aluminium alloy. In one example, the brush body 38 houses durable and resilient bristles 39 which may be made from spring steel or a plastic compound. The abrasive action of the bristles 39 coupled with axial reciprocation of the tubing 102 optionally aids in creating a clean setting area for the packer 1 to be set.

Figure 12:
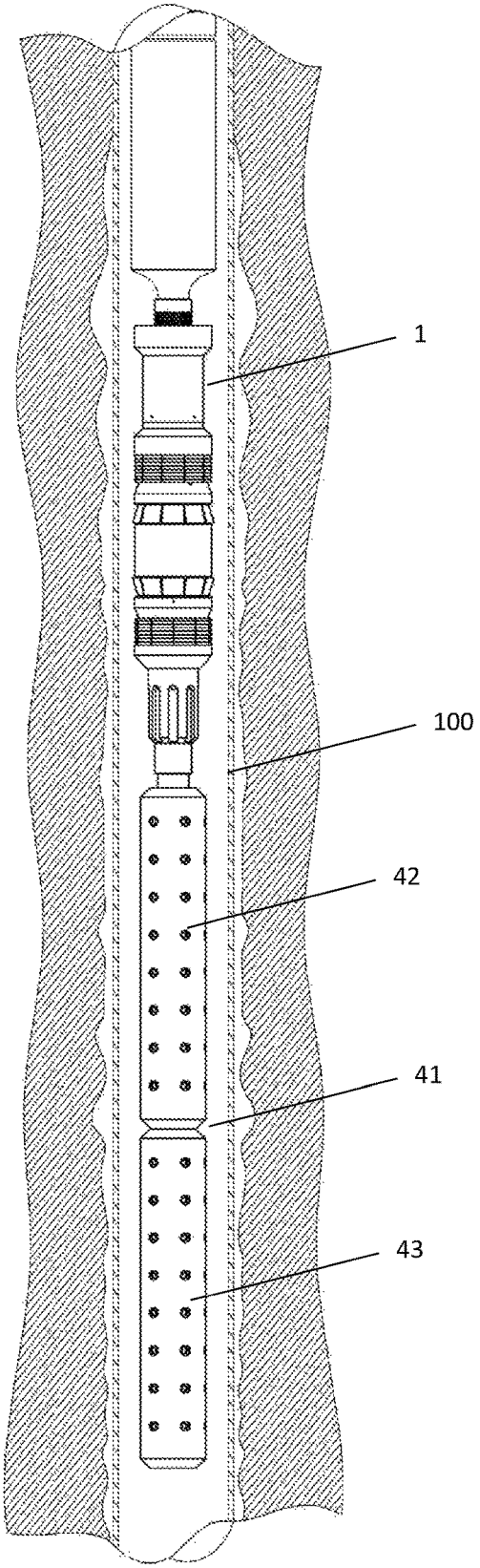
FIG. 12 shows an optional modification of a squeeze packer assembly where perforation guns are connected to the end of the packer. This allows the complete remedial cementing operations to be conducted on a single run.

FIG. 12 shows further optional modified example where perforating guns 41 are connected to the end of the packer 1 (which is shown in schematic view in FIG. 12, but could be the same as that described above). In a single run, the perforation guns 41 can create perforations in the casing 100 prior to setting the packer 1. The perforation guns 41, can optionally be activated by pressure or by other mechanisms. Optionally, upper perforating guns 42 can be used to create upper perforations and lower perforating guns 43 is used to create lower perforations on the same trip. The upper perforations are optionally created first before creating the lower perforations. The packer 1 is then positioned between the upper and lower perforations before being set and beginning remedial cementing operations, as described above.

Figure 13:
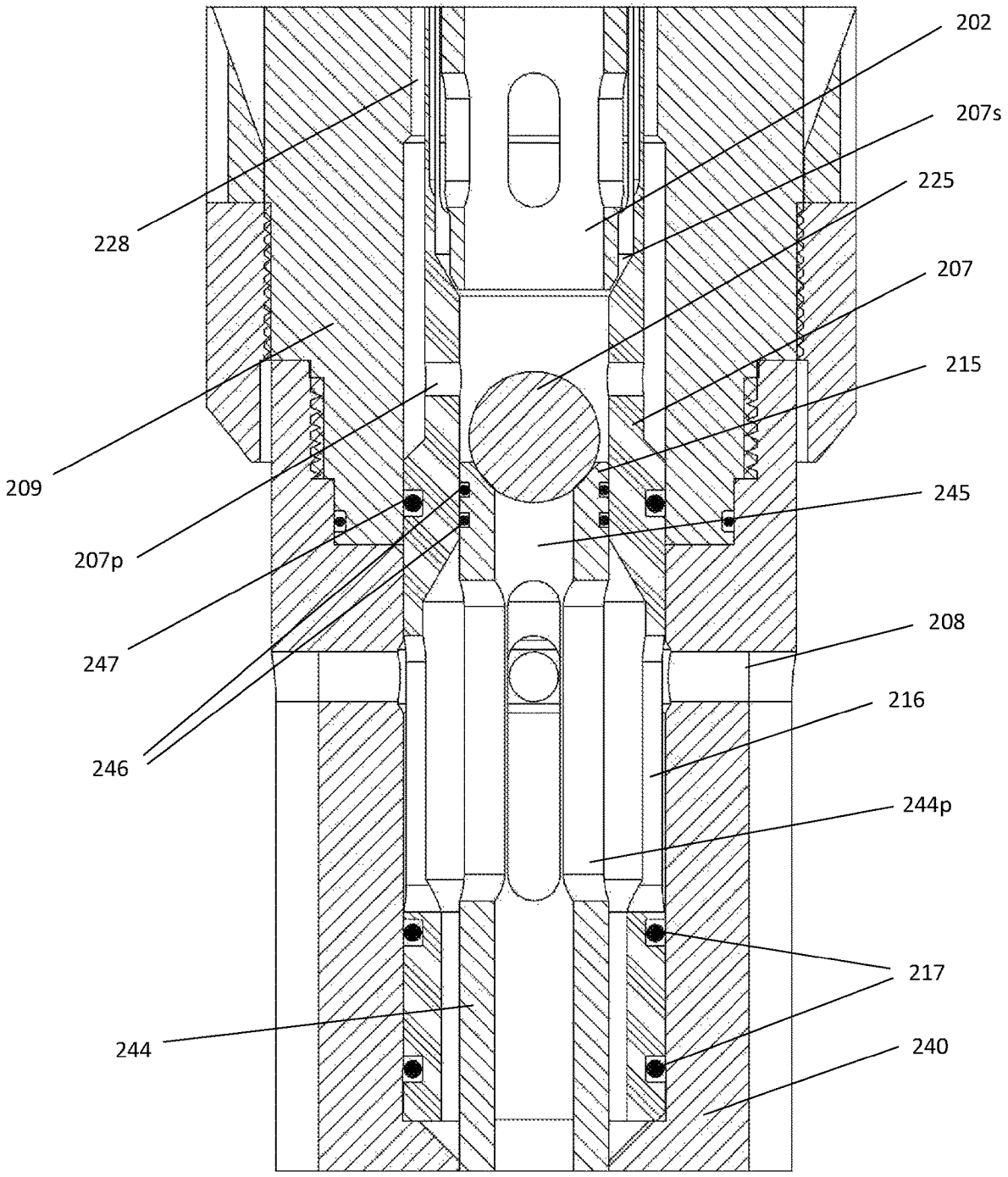
FIG. 13 shows an optional modification of the squeeze packer assembly in which the valve comprises a sleeve which slides axially downwards relative to a static ball seat in the housing which allows hydraulic pressure to build up and set the upper slips.
Figure 14:
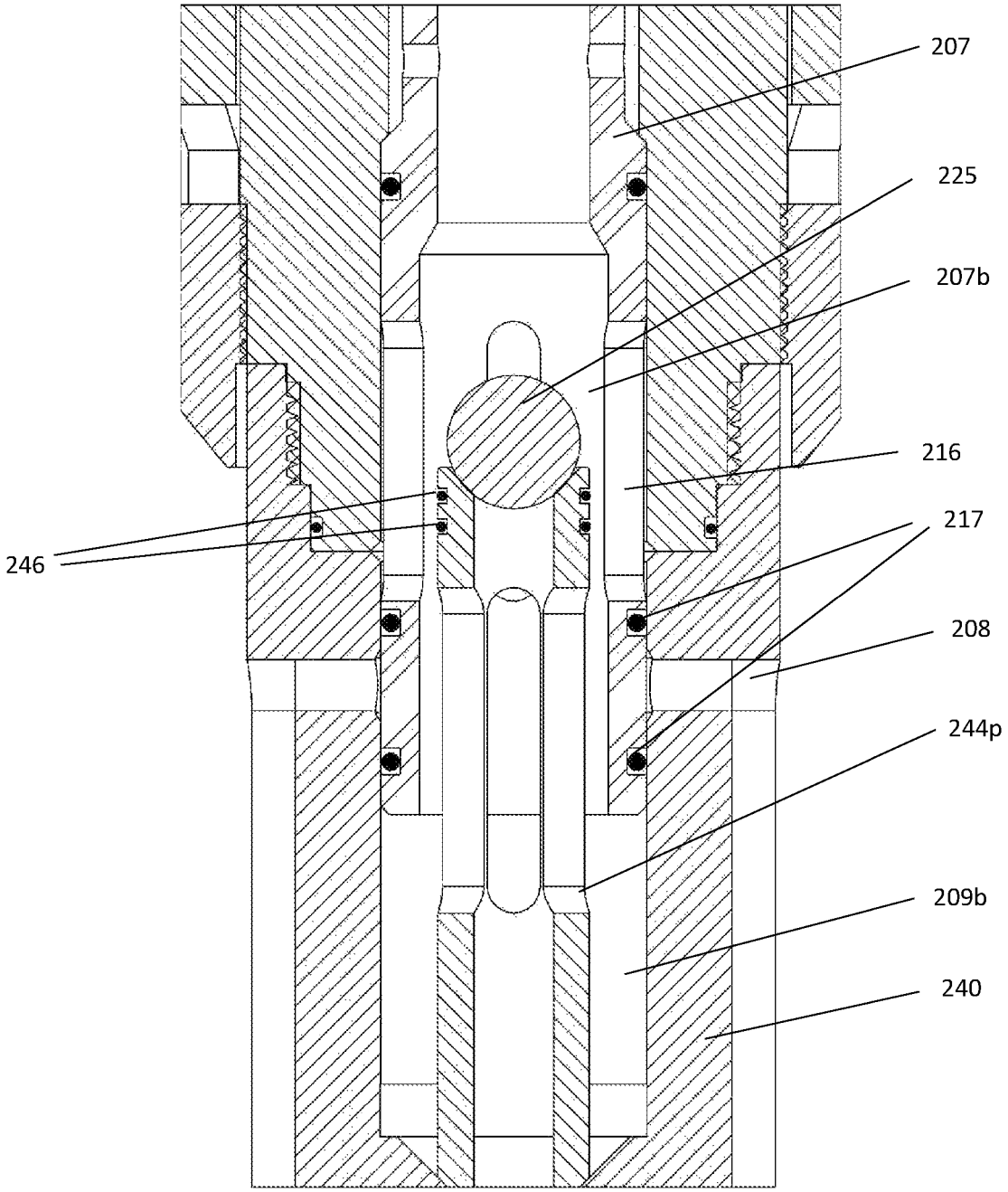
FIG. 14 shows the FIG. 13 arrangement with the sleeve sliding upwards into a closed configuration.
Figure 15:
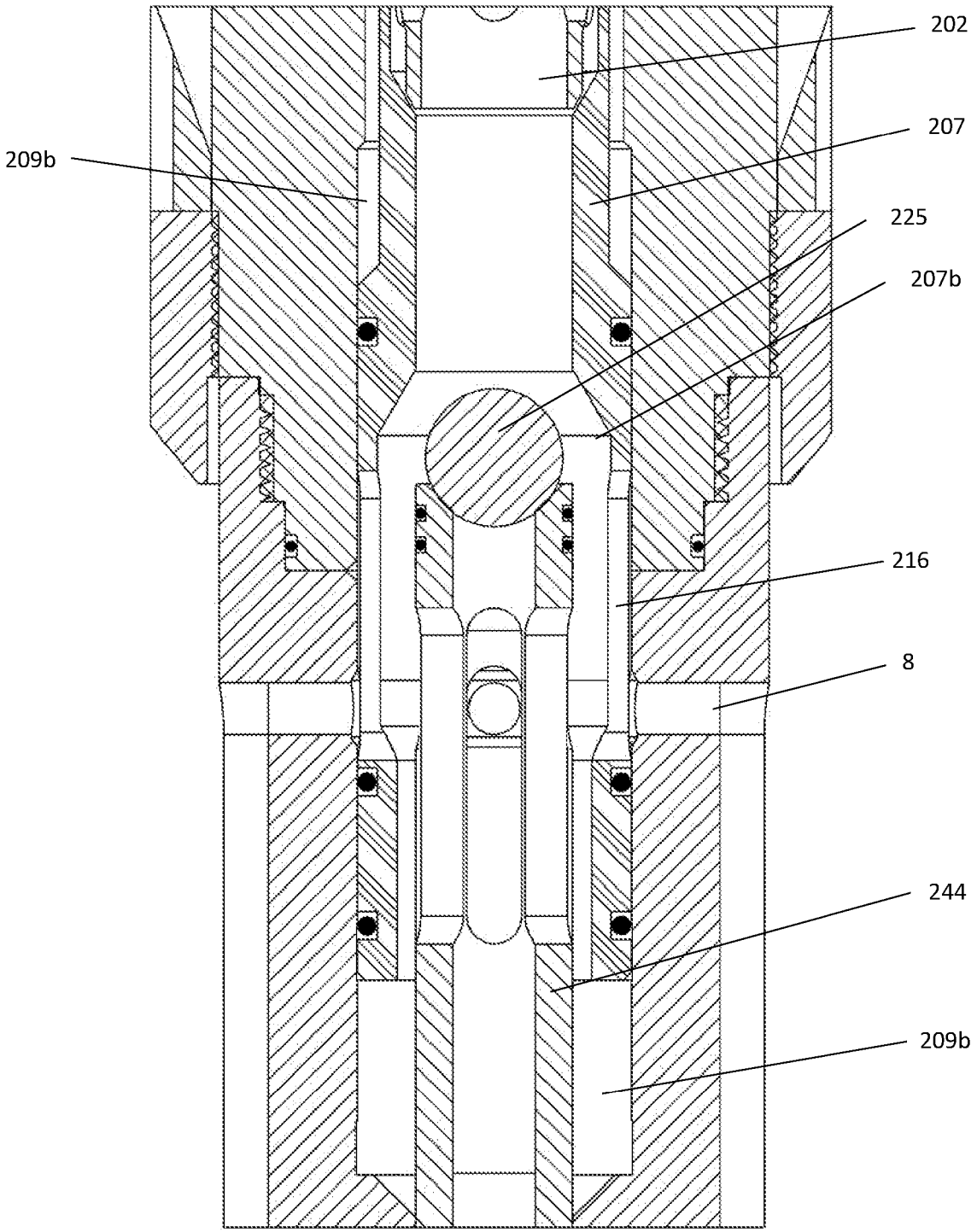
FIG. 15 shows the FIG. 13 arrangement with the sleeve sliding downwards into a circulating position.

FIGS. 13-15 show a variation of a squeeze packer assembly 201 similar to that described above, having similar components (for which the same numbering will be used herein but increased by 200) with a mandrel 209, stinger 202, and gripping and sealing members and being deployed on tubing 101 as previously described. The structure and function of these components of the squeeze packer assembly 201 is similar to those described for the previous example, and will not be described herein in detail. The squeeze packer assembly 201 differs from the previous example in the configuration of the shuttle sleeve 207 and the ball seat 215.

In the present example of FIGS. 13-15, the shuttle sleeve 207 comprises a sliding sleeve as previously described sliding inside the bore of the mandrel 209 with a bore 209*b* with a latch provided by a collet having resilient fingers at an upper end which engage in a groove on the outer surface of the stinger 202 when the stinger 202 stabs into the bore of the mandrel 209 and can be released by pulling up on the stinger 202 until the tips of the fingers of the latch are axially aligned with a larger diameter section of the bore of the mandrel 209 just as described in the previous example. Essentially the upper end of the shuttle sleeve 207 is very similar to the upper end of the shuttle sleeve 7 in the previous example, with a narrow outer diameter creating an annular space between the outer surface of the shuttle sleeve 207 and the inner surface of the bore of the mandrel 209.

However, in this example, the sliding shuttle sleeve 207 is without a ball seat, and the chamfered lower end of the stinger 202 engages on a complementarily chamfered shoulder 207*s* in the bore of the shuttle sleeve 207. The inner diameter of the end of the stinger 207 is the same as the inner diameter of the shoulder 207*s*, so the ball 225 passes through the stinger 202 and into the shuttle sleeve 207 without seating in the shuttle sleeve 207, unlike in the previous example. In the assembly 201, the lower section of the shuttle sleeve 207 has an expanded inner diameter larger than the diameter of the ball 225, so there is a clearance between the inner surface of the lower part of the shuttle sleeve 207 and the ball 225 as best seen in FIG. 13. The lower section has the same slotted valve ports 216 in the side walls, and is sealed to the inner surface of the mandrel 209 by seals 247 and 217 (in the present example 201 there is no housing sleeve between the bore of the mandrel 209 and the shuttle sleeve 207, and the shuttle sleeve 207 bears directly on the inner surface of the bore of the mandrel 209.

The ball 225 seats on a chamfered ball seat 215 set on the top of a tubular central pillar 244 fixed in position in the base of the end cap in line with the central axis of the bore of the mandrel 209 and protruding axially into the opening at the lower end of the bore of the mandrel 209. The pillar 244 has annular seals 246 on its outer surface, underneath the ball seat 215. The pillar 244 has a hollow bore 245 and side ports 244*p*, and the end opposite the ball seat 215 has a blind end where the pillar 244 is fixed to the end cap 240.

The shuttle sleeve has an external circumferential seal 247 on a waist between its upper and lower ends. The outer diameter of the shuttle sleeve 207 steps radially outward just above the waist ending the annular space outside the shuttle sleeve 207 above the waist, and just below the waist the inner diameter also steps radially outward, leaving the waist with a larger radial thickness, disposed at the boundary where the inner and outer diameters step radially outwards. Below the waist, the outer surface of the shuttle sleeve 207 is pressed against the inner surface of the bore of the mandrel 209, but the inner surface of the shuttle sleeve 207 defines an annular gap between the shuttle sleeve 207 and the pillar 244, through which fluid can flow.

In the running in position with the stinger 202 fully inserted into the mandrel 209 as shown in FIG. 13, and with the stinger 202 latched onto the top of the shuttle sleeve 207, but before the ball 225 is seated on the seat 215, fluid can flow between the bore in the stinger 202, the bore 245 in the pillar 244, the side ports 244*p*, the valve ports 216 and the circulation ports 208 on the end cap 240, and hence the assembly 201 can be run in without surging or other undesirable hydraulic effects as described for the first example.

Once the ball 225 is dropped and lands on the chamfered profile of the ball seat 215, the fluid pathway through the bore 245 of the pillar 244 is blocked. The seals 246 on the outer surface of the pillar 244 compress between the outer surface of the pillar 244 and the inner surface of the waist of the shuttle sleeve 207, while seals 247 on the outer surface of the waist of the sliding shuttle sleeve 207 seal the annular area between the bore of the mandrel 209 and the outer surface of the shuttle sleeve 207, hence blocking fluid flow between upper and lower ends of the shuttle sleeve 207. Hydraulic pressure injected from the stinger 202 is communicated through setting ports 207*p* above the waist of the shuttle sleeve 207 and builds up in the annulus 228 between the stinger 202 and the mandrel 209 which is enough to set the upper slips as previously described for the above example.

FIG. 14 shows the assembly 201 after the packer has set. The stinger 202 has been pulled upwards and moved the shuttle sleeve 207 into the upper closed position until the radial step outwards on between the upper end and the waist shoulders out on an internal counter-bored shoulder on the mandrel 209. The ball 25 remains seated on the profile on the pillar 244, but as the shuttle sleeve 207 rises in the bore of the mandrel 209 relative to the pillar 244, the radially thick waist clears the seals 246 on the outer surface of the pillar 244 which unload, allowing fluid communication between the upper and lower ends of the shuttle sleeve. Hence, fluid can now flow around the ball 215 from the bore of the stinger 202, through the bore 207*b* of the shuttle sleeve 207, and into the annular area at the lower end of the shuttle sleeve 207 between the shuttle sleeve 207 and the outer diameter of the pillar 244. The circumferential seals 217 have also moved upwards in the bore of the mandrel 209 and are compressed between the shuttle sleeve 207 and the mandrel 209 above and below the circulation ports 208, thereby preventing escape of fluid from the ports 208 in the FIG. 14 configuration. The stinger 202 can at this stage be withdrawn completely, automatically unlatching from the resilient fingers at the upper end of the shuttle sleeve 207 as in the first example, and can re-engage in the latch upon insertion into the bore of the packer as previously described, or it can remain in place in this configuration.

FIG. 15 shows the next progression of the assembly 201. After the packer has fully set and the stinger 202 is retracted from the packer, closing off circulation, the packer can be opened again to allow circulation through the tool. The stinger 202 is stabbed into the bore of the mandrel 209 to re-engage with the latch on the upper end of the shuttle sleeve 207 and reconnect the stinger 202 onto the shuttle valve 207 when the stinger 202 moves down the bore 209*b* from the FIG. 14 configuration. At this point, the stinger 202 pushes the shuttle sleeve 207 down the bore 209*b* at the same time, causing the slots 216 on the shuttle sleeve 207 to line up axially with the circulation ports 208. This allows fluid communication between the bore of the stinger 202 and the annulus below the packer, via the annular space between the pillar 244 and the shuttle sleeve 207 and the circulation ports 208. The stinger 202 does not necessarily need to push the shuttle sleeve 207 all the way down the bore 209*b* back into the same position as FIG. 13, but merely moves it until the two seals 217 are below the circulation ports 208; the stinger 202 and the shuttle sleeve 207 are optionally prevented from further axial movement by the no-go created by the abutting of the threads 33 and 34. The top of the pillar 244 does not necessarily enter the narrower bore of the upper end of the shuttle sleeve 207, so there is provided an annular flow path around the ball 225 which allows fluid to pass around the ball 225 into the annular area below the set packer via the circulation ports 8.

The invention claimed is:

1. A squeeze packer assembly for deployment in a wellbore of an oil, gas or water well on an elongate member, the squeeze packer assembly comprising a body having a bore, at least one anchoring member actuable between active and inactive configurations in response to changes in fluid pressure, and wherein in the active configuration, the anchoring member is adapted to anchor the body in the wellbore to resist axial movement of the body in the wellbore, and a sealing member adapted to seal an annulus between the body and an inner surface of the wellbore;

a stinger adapted for connection to the elongate member for injection of a fluid through the bore of the body;

a latch adapted to releasably latch the stinger onto the body; and a valve selectively actuable to open and close the bore to allow and prevent fluid passage through the body, wherein the valve controls passage of pressurised fluid to the anchoring member to actuate the anchoring member between inactive and active configurations, and wherein the valve is controlled by axial movement of the stinger and the elongate member relative to the body to actuate the valve between different actuation configurations, and wherein the stinger is released from the body by rotation of the elongate member in a direction opposite to a direction of rotation used to disconnect threaded couplings making up the elongate member;

wherein the anchoring member comprises first and second sets of slips and wherein the first set of slips is set by hydraulic pressure before the second set is set mechanically by exerting an axial force on the elongate member.

2. The squeeze packer assembly as claimed in claim 1, wherein the valve comprises a sleeve slidable axially within the bore of the body to shift the valve between different actuation states.

3. The squeeze packer assembly as claimed in claim 1, wherein the latch comprises a collet having plurality of resilient fingers disposed on the end of a sleeve slidable axially within the bore of the body, wherein the sleeve comprises one or more ports to permit fluid flow, and wherein the resilient fingers are resiliently biased radially inwards with respect to an axis of the collet and wherein the resilient fingers on the collet releasably engage with a recess on the stinger.

4. The squeeze packer assembly as claimed in claim 3, wherein the collet comprises a cylindrical sleeve with an inwardly projecting cylindrical shoulder mounted on at least two of the fingers which combine to form a seat to receive and to seat a valve closure device.

5. The squeeze packer assembly as claimed in claim 1, wherein the valve has a seat disposed in the bore of the body and wherein seating a valve closure member on the seat diverts fluid through the bore of the body to set a first set of slips forming an anchoring member.

6. The squeeze packer assembly as claimed in claim 5, wherein the seat is resiliently biased radially inwards, and upon removal of the bias is adapted to resiliently expand to release a seated valve closure member.

7. The squeeze packer assembly as claimed in claim 1, wherein the valve comprises a cylindrical sleeve slidable axially in a valve housing having a clearance gap between the valve housing and the cylindrical sleeve.

8. The squeeze packer assembly as claimed in claim 1, wherein the valve is adapted to slide axially in the bore of the body after hydraulic setting of the anchoring member.

9. The squeeze packer assembly as claimed in claim 1, wherein the force on the elongate member to set the second set of slips activates the sealing member.

10. The squeeze packer assembly as claimed in claim 1 wherein the stinger has a smooth outer surface.

11. The squeeze packer assembly as claimed in claim 1, wherein the valve is adapted to be repeatedly cycled within the body between different configurations to open and close the bore through the packer before injecting fluid through the bore of the packer.

12. The squeeze packer assembly as claimed in claim 1, wherein the latch is adapted to cycle between disconnected and connected configurations to disconnect and reconnect the stinger and the packer.

13. The squeeze packer assembly as claimed in claim 1, incorporating a seat adapted to be closed by a valve closure member, wherein the seat remains static within the bore in open and closed configurations of the valve, and wherein the valve comprises a sleeve adapted to move axially within the bore relative to the static seat, between the open and closed configurations.

14. The squeeze packer assembly as claimed in claim 13, wherein the sleeve has a first section with a first diameter and a second section with a second diameter different from the first diameter, and wherein in an open configuration, the seat is disposed within the first section and in the closed configuration, the seat is disposed in the second section.

15. The squeeze packer assembly as claimed in claim 14, wherein the sleeve has a waist between the first and second sections, and wherein the waist incorporates a step in the inner and outer diameters of the sleeve.

16. The squeeze packer assembly as claimed in claim 15, having an annular fluid flowpath between the first section of the sleeve and the bore, wherein the outer diameter of the sleeve steps radially outward at the interface between the first section and the waist, and wherein the inner diameter of the sleeve steps radially outward at the interface between the second section and the waist, and wherein the sleeve has an annular fluid flowpath between the second section of the sleeve and the seat.

17. A method of injecting a fluid into a wellbore of an oil, gas or water well through an elongate member, the method comprising:

deploying a squeeze packer into the wellbore, the squeeze packer comprising:

a body with a bore, at least one anchoring member actuable between active and inactive configurations in response to changes in fluid pressure, and wherein in the active configuration, the anchoring member is adapted to anchor the body in the wellbore to resist axial movement of the body in the wellbore, and a sealing member adapted to seal an annulus between the body and an inner surface of the wellbore;

a stinger adapted for connection to the elongate member for injection of a fluid through the packer, the stinger being releasably latched onto the body; and a valve selectively actuable to open and close the bore to allow and prevent fluid passage through the body, wherein the valve controls passage of pressurised fluid to the anchoring member to actuate the anchoring member between inactive and active configurations;

the method including:

anchoring the squeeze packer in the wellbore and sealing the annulus between the body and the inner surface of the wellbore;

releasing the stinger from the packer by rotation of the elongate member in a direction opposite to the direction of rotation used to disconnect the threaded couplings making up the elongate member, and moving the stinger axially within the body to actuate the valve between different actuation configurations;

wherein the anchoring member comprises first and second sets of slips and wherein the first set of slips is set by hydraulic pressure before the second set is set mechanically by exerting an axial force on the elongate member.

18. The method as claimed in claim 17, including actuating the valve to control passage of pressurised fluid to the anchoring member to actuate the anchoring member between inactive and active configurations.

19. The method as claimed in claim 17, wherein the valve includes a sleeve, including sliding the sleeve axially within the bore between different actuation configurations of the packer, and including sliding the sleeve relative to a seat adapted to close the bore by seating of a valve closure member on the seat.

20. The method as claimed in claim 19, wherein the sleeve has a first section with a first inner diameter and a second section with a second inner diameter, and wherein the method include sliding the sleeve over the seated valve closure member on the seat between a first valve configuration and a second valve configuration, wherein in the first valve configuration the valve closure member is in the first section and fluid cannot pass through the sleeve, and wherein in the second valve configuration, the valve closure member is in the second section of the sleeve, and wherein fluid can pass through the sleeve.

21. The method as claimed in claim 17, wherein the stinger is adapted to be connected to the body by a threaded connection, wherein the thread is connected by anti-clockwise rotation of the stinger with respect to the body and is disconnected by clockwise rotation of the stinger with respect to the body, and wherein the stinger is disconnected from the body by clockwise rotation relative to the body.

22. The method as claimed in claim 17, wherein the valve has a seat disposed in the bore and wherein the method includes seating a valve closure member on the seat and setting the anchoring member by hydraulic pressure diverted through the bore of the body by the valve closure member on the seat.

23. The method as claimed in claim 17, wherein the stinger is adapted to be latched to the valve, and wherein the method includes latching the stinger to the valve and sliding the valve between different actuation configurations by axial movement of the stinger relative to the body, releasing the stinger from the body and unlatching the stinger from the valve, circulating fluid through the stinger to pressure test the seal between the sealing member and the inner surface of the wellbore, reconnecting the stinger to the body and re-latching the stinger to the valve and sliding the valve between different actuation configurations by axial movement of the stinger relative to the body.

24. A squeeze packer assembly for deployment in a wellbore of an oil, gas or water well on an elongate member, the squeeze packer assembly comprising a body having a bore, at least one anchoring member actuable between active and inactive configurations in response to changes in fluid pressure, wherein the anchoring member comprises first and second sets of slips and wherein the first set of slips is set by hydraulic pressure before the second set is set mechanically by exerting an axial force on the elongate member, and wherein in the active configuration, the anchoring member is adapted to anchor the body in the wellbore to resist axial movement of the body in the wellbore, and a sealing member adapted to seal an annulus between the body and an inner surface of the wellbore;

a stinger adapted for connection to the elongate member for injection of a fluid through the body;

a latch adapted to releasably latch the stinger onto the body; and a valve selectively actuable to open and close the bore to allow and prevent fluid passage through the body, wherein the valve controls passage of pressurised fluid to the anchoring member to actuate the anchoring member between inactive and active configurations, and wherein the valve is controlled by axial movement of the stinger and the elongate member relative to the body to actuate the valve between different actuation configurations;

wherein the stinger is connected to the body by a threaded connection, wherein the thread is connected by anti-clockwise rotation of the stinger with respect to the body and is disconnected by clockwise rotation of the stinger with respect to the body, and wherein the stinger is adapted to be disconnected from the body by clockwise rotation relative to the body;

wherein the valve has a seat disposed in the bore and wherein seating a valve closure member on the seat sets the anchoring member by hydraulic pressure diverted through the bore of the body by the valve closure member on the seat; and wherein the sealing member is expanded in the annulus between the body and an inner surface of the wellbore to seal the annulus by pulling up on the elongate member.

* * * * *